US009712939B2

(12) United States Patent
Mateos Sole et al.

(10) Patent No.: US 9,712,939 B2
(45) **Date of Patent: *Jul. 18, 2017**

(54) PANNING OF AUDIO OBJECTS TO ARBITRARY SPEAKER LAYOUTS

(71) Applicants: DOLBY INTERNATIONAL AB, Amsterdam (NL); DOLBY LABORATORIES LICENSING CORPORATION, San Francisco, CA (US)

(72) Inventors: Antonio Mateos Sole, Barcelona (ES); Giulio Cengarle, Barcelona (ES); Dirk Jeroen Breebart, Pyrmont (AU); Nicolas R. Tsingos, Palo Alto, CA (US)

(73) Assignees: Dolby Laboratories Licensing Corporation, San Francisco, CA (US); Dolby International AB, Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/908,094

(22) PCT Filed: Jun. 17, 2014

(86) PCT No.: PCT/US2014/042768

§ 371 (c)(1),
(2) Date: Jan. 27, 2016

(87) PCT Pub. No.: WO2015/017037

PCT Pub. Date: Feb. 5, 2015

(65) Prior Publication Data

US 2016/0212559 A1 Jul. 21, 2016

Related U.S. Application Data

(60) Provisional application No. 62/009,536, filed on Jun. 9, 2014.

(30) Foreign Application Priority Data

Jul. 30, 2013 (ES) ..... 201331169

(51) Int. Cl.
*H04R 5/02* (2006.01)
*H04S 7/00* (2006.01)

(52) U.S. Cl.
CPC ..... *H04S 7/30* (2013.01); *H04S 2400/03* (2013.01); *H04S 2400/11* (2013.01)

(58) Field of Classification Search
CPC ... G10L 19/008; G10L 19/20; H04S 2400/03; H04S 2400/11; H04S 3/02; H04S 2400/01; H04S 2420/03; H04S 7/30
(Continued)

(56) References Cited

U.S. PATENT DOCUMENTS

2005/0114121 A1* 5/2005 Tsingos ..... H04S 7/30 704/220
2006/0280311 A1 12/2006 Beckinger
(Continued)

FOREIGN PATENT DOCUMENTS

JP 2009-501462 1/2009
RS 1332 U 8/2013
(Continued)

OTHER PUBLICATIONS

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

(Continued)

*Primary Examiner* — Alexander Jamal

(57) ABSTRACT

A gain contribution of the audio signal for each of the N audio objects to at least one of M speakers may be determined. Determining the gain contribution may involve determining a center of loudness position that is a function of speaker (or cluster) positions and gains assigned to each speaker (or cluster). Determining the gain contribution also (Continued)

may involve determining a minimum value of a cost function. A first term of the cost function may represent a difference between the center of loudness position and an audio object position.

15 Claims, 14 Drawing Sheets

(58) Field of Classification Search
USPC ..... 381/303, 20, 22, 23, 310, 306, 307, 300
See application file for complete search history.

(56) References Cited

U.S. PATENT DOCUMENTS

| | | | | |
|---|---|---|---|---|
| 2012/0314875 | A1 | 12/2012 | Lee | |
| 2013/0101122 | A1 | 4/2013 | Yoo | |
| 2013/0142341 | A1* | 6/2013 | Del Galdo | G10L 19/008 381/23 |
| 2014/0023196 | A1 | 1/2014 | Xiang | |
| 2015/0332680 | A1 | 11/2015 | Crockett | |

FOREIGN PATENT DOCUMENTS

| | | |
|---|---|---|
| WO | 2011/054876 | 5/2011 |
| WO | 2011/160850 | 12/2011 |
| WO | 2012/072804 | 6/2012 |
| WO | 2012/125855 | 9/2012 |
| WO | 2013/000740 | 1/2013 |
| WO | 2013/006325 | 1/2013 |
| WO | 2013/006338 | 1/2013 |
| WO | 2014/025752 | 2/2014 |
| WO | 2014/187986 | 11/2014 |
| WO | 2014/187989 | 11/2014 |
| WO | 2015/017223 | 2/2015 |
| WO | 2015/017235 | 2/2015 |
| WO | 2015/105748 | 7/2015 |
| WO | 2015/130617 | 9/2015 |

OTHER PUBLICATIONS

Stanojevic, Tomislav "Surround Sound for a New Generation of Theaters," Sound and Video Contractor, Dec. 20, 1995, 7 pages.
Stanojevic, Tomislav "Virtual Sound Sources in the Total Surround Sound System," SMPTE Cont Proc.,1995, pp. 405-421.
Stanojevic, Tomislav et al. "Designing of TSS Halls," 13th International Congress on Acoustics, Yugoslavia, 1989, pp. 326-331.
Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.
Stanojevic, Tomislav et al. "The Total Surround Sound (TSS) Processor," SMPTE Journal, Nov. 1994, pp. 734-740.
Stanojevic, Tomislav et al. "The Total Surround Sound System (TSS System)", 86th AES Convention, Hamburg, Germany, Mar. 7-10, 1989, 21 pages.
Stanojevic, Tomislav et al. "TSS Processor" 135th SMPTE Technical Conference, Los Angeles Convention Center, Los Angeles, California, Society of Motion Picture and Television Engineers, Oct. 29-Nov. 2, 1993, 22 pages.
Stanojevic, Tomislav et al. "TSS System and Live Performance Sound" 88th AES Convention, Montreux, Switzerland, Mar. 13-16, 1990, 27 pages.
Jot, Jean-Marc "Interactive 3D Audio Rendering in Flexible Playback Configurations" IEEE Signal & Information Processing Association Annual Summit and Conference Asia-Pacific, Dec. 3-6, 2012, pp. 1-9.
Tsingos, N. et al "Breaking the 64 Spatialized Sources Barrier" Internet Citation, May 29, 2003, pp. 1-8.
Pulkki, Ville "Virtual Sound Source Positioning Using Vector Base Amplitude Panning" Journal of the Audio Engineering Society, vol. 45, No. 6, Jun. 1, 1996, pp. 456-466.
Tsingos, N. et al "Perceptual Audio Rendering of Complex Virtual Environments" ACM Transactions on Graphics vol. 23, No. 3, Aug. 1, 2004, pp. 249-258.
Herder, Jens "Optimization of Sound Spatialization Resource Management Through Clustering" 3D—EIZO—Journal of Three Dimensional Images, Tokyo, JP, vol. 13, No. 3, Sep. 1, 1999, pp. 59-63.
Pulkki, Ville "Compensating Displacement of Amplitude-Panned Virtual Sources" AES 22nd International Conference: Virtual, Synthetic, and Entertainment Audio, Jun. 1, 2002, pp. 1-10.
Hoppner, F. et al "Fuzzy Cluster Analysis, Methods for Classification, Data Analysis and Image Recognition" John Wiley & Sons, Ltd. Jan. 31, 2000, pp. 17-28.

* cited by examiner

PANNING OF AUDIO OBJECTS TO ARBITRARY SPEAKER LAYOUTS

CROSS-REFERENCE TO RELATED APPLICATIONS

This application claims priority from Spanish Patent Application No. P201331169 filed 30 Jul. 2013 and U.S. Provisional Patent Application No. 62/009,536 filed 9 Jun. 2014 each of which is hereby incorporated by reference in its entirety.

TECHNICAL FIELD

This disclosure relates to processing audio data. In particular, this disclosure relates to processing audio data corresponding to audio objects.

BACKGROUND

Since the introduction of sound with film in 1927, there has been a steady evolution of technology used to capture the artistic intent of the motion picture sound track and to reproduce this content. In the 1970s Dolby introduced a cost-effective means of encoding and distributing mixes with 3 screen channels and a mono surround channel. Dolby brought digital sound to the cinema during the 1990s with a 5.1 channel format that provides discrete left, center and right screen channels, left and right surround arrays and a subwoofer channel for low-frequency effects. Dolby Surround 7.1, introduced in 2010, increased the number of surround channels by splitting the existing left and right surround channels into four "zones."

Both cinema and home theater audio playback systems are becoming increasingly versatile and complex. Home theater audio playback systems are including increasing numbers of speakers. As the number of channels increases and the loudspeaker layout transitions from a planar two-dimensional (2D) array to a three-dimensional (3D) array including elevation, reproducing sounds in a playback environment is becoming an increasingly complex process. Improved audio processing methods would be desirable.

SUMMARY

Improved methods for processing audio objects are provided. As used herein, the term "audio object" refers to audio signals (also referred to herein as "audio object signals") and associated metadata that may be created or "authored" without reference to any particular playback environment. The associated metadata may include audio object position data, audio object gain data, audio object size data, audio object trajectory data, etc. As used herein, the terms "clustering" and "grouping" or "combining" are used interchangeably to describe the combination of objects and/or beds (channels) into "clusters," in order to reduce the amount of data in a unit of adaptive audio content for transmission and rendering in an adaptive audio playback system. As used herein, the term "rendering" may refer to a process of transforming audio objects or clusters into speaker feed signals for a particular playback environment. A rendering process may be performed, at least in part, according to the associated metadata and according to playback environment data. The playback environment data may include an indication of a number of speakers in a playback environment and an indication of the location of each speaker within the playback environment.

Some implementations described herein may involve receiving audio data that includes N audio objects. The audio objects may include audio signals and associated metadata. The metadata may include at least audio object position data. In some implementations, the method may involve performing an audio object clustering process that produces M clusters from the N audio objects, M being a number less than N.

The clustering process may involve selecting M representative audio objects and determining a cluster centroid position for each of the M clusters according to audio object position data of each of the M representative audio objects. In some implementations, each cluster centroid position may be a single position that is representative of positions of all audio objects associated with a cluster.

The clustering process may involve determining a gain contribution of the audio signal for each of the N audio objects to at least one of the M clusters. In some implementations, determining the gain contribution may involve determining a center of loudness position and determining a minimum value of a cost function. In some examples, a first term of the cost function may represent a difference between the center of loudness position and an audio object position.

In some implementations, the center of loudness position may be a function of cluster centroid positions and gains assigned to each cluster. In some examples, determining the center of loudness position may involve combining cluster centroid positions via a weighting process in which a weight applied to a cluster centroid position corresponds to a gain assigned to the cluster centroid position. For example, determining the center of loudness position may involve: determining products of each cluster centroid position and a gain assigned to each cluster centroid position; calculating a sum of the products; determining a sum of the gains for all cluster centroid positions; and dividing the sum of the products by the sum of the gains.

In some implementations, a second term of the cost function may represent a distance between the object position and a cluster centroid position. For example, the second term of the cost function may be proportional to a square of the distance between the object position and a cluster centroid position. In some implementations, a third term of the cost function may set a scale for determined gain contributions. In some implementations, the cost function may be a quadratic function of the gains assigned to each cluster. However, in other implementations the cost function may not be a quadratic function.

In some implementations, the method may involve modifying at least one cluster centroid position according to gain contributions of audio objects in the corresponding cluster. In some examples, at least one cluster centroid position may be time-varying.

Some alternative implementations described herein also may involve receiving audio data that includes N audio objects. The audio objects may include audio signals and associated metadata. The metadata may include at least audio object position data. In some implementations, the method may involve determining a gain contribution of the audio signal for each of the N audio objects to at least one of M speakers.

For example, determining the gain contribution may involve determining a center of loudness position and determining a minimum value of a cost function. The center of loudness position may be a function of speaker positions and gains assigned to each speaker. In some examples, a first term of the cost function may represent a difference between the center of loudness position and an audio object position.

Determining the center of loudness position may involve combining speaker positions via a weighting process in which a weight applied to a speaker position corresponds to a gain assigned to the speaker position. For example, determining the center of loudness position may involve: determining products of each speaker position and a gain assigned to each corresponding speaker; calculating a sum of the products; determining a sum of the gains for all speakers; and dividing the sum of the products by the sum of the gains.

In some implementations, a second term of the cost function may represent a distance between the audio object position and a speaker position. For example, the second term of the cost function may be proportional to a square of the distance between the audio object position and a speaker position. In some implementations, a third term of the cost function sets a scale for determined gain contributions.

In some implementations, the cost function may be a quadratic function of the gains assigned to each speaker. However, in other implementations the cost function may not be a quadratic function.

The methods disclosed herein may be implemented via hardware, firmware, software stored in one or more non-transitory media, and/or combinations thereof. For example, at least some aspects of this disclosure may be implemented in an apparatus that includes an interface system and a logic system. The interface system may include a user interface and/or a network interface. In some implementations, the apparatus may include a memory system. The interface system may include at least one interface between the logic system and the memory system.

The logic system may include at least one processor, such as a general purpose single- or multi-chip processor, a digital signal processor (DSP), an application specific integrated circuit (ASIC), a field programmable gate array (FPGA) or other programmable logic device, discrete gate or transistor logic, discrete hardware components, and/or combinations thereof. In some implementations, the logic system may be capable of performing, at least in part, the methods disclosed herein according to software stored one or more non-transitory media.

In some implementations, the logic system may be capable of receiving, via the interface system, audio data that includes N audio objects and determining a gain contribution of the audio object signal for each of the N audio objects to at least one of M speakers. The audio objects may include audio signals and associated metadata. The metadata may include at least audio object position data. In some examples, determining the gain contribution may involve determining a center of loudness position and determining a minimum value of a cost function. The center of loudness position may be a function of speaker positions and gains assigned to each speaker. A first term of the cost function may represent a difference between the center of loudness position and an audio object position. In some implementations, determining the center of loudness position may involve combining speaker position via a weighting process in which a weight applied to a speaker position corresponds to a gain assigned to the speaker position.

In some implementations, the logic system may be capable of receiving, via the interface system, audio data that includes N audio objects and determining a gain contribution of the audio object signal for each of the N audio objects to at least one of M clusters. The audio objects may include audio signals and associated metadata. The metadata may include at least audio object position data.

In some implementations, the logic system may be capable of performing an audio object clustering process that produces M clusters from the N audio objects, M being a number less than N. For example, the clustering process may involve: selecting M representative audio objects; determining a cluster centroid position for each of the M clusters according to audio object position data of each of the M representative audio objects; and determining a gain contribution of the audio object signal for each of the N audio objects to at least one of the M clusters. Each cluster centroid position may be a single position that is representative of positions of all audio objects associated with a cluster. In some implementations, at least one cluster centroid position may be time-varying.

In some examples, determining the gain contribution may involve determining a center of loudness position and determining a minimum value of a cost function. The center of loudness position may be a function of cluster centroid positions and gains assigned to each cluster. A first term of the cost function may represent a difference between the center of loudness position and an audio object position. In some implementations, determining the center of loudness position may involve combining cluster centroid positions via a weighting process in which a weight applied to a cluster centroid position corresponds to a gain assigned to the cluster centroid position.

In some implementations, a second term of the cost function may represent a distance between the object position and a speaker position or a cluster centroid position. For example, the second term of the cost function may be proportional to a square of the distance between the object position and a speaker position or a cluster centroid position. In some implementations, a third term of the cost function sets a scale for determined gain contributions. In some implementations, the cost function may be a quadratic function of the gains assigned to each speaker or cluster. However, in other implementations the cost function may not be a quadratic function.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular playback environments, the teachings herein are widely applicable to other known playback environments, as well as playback environments that may be introduced in the future. Moreover, the described implementations may be implemented, at least in part, in various devices and systems as hardware, software, firmware, cloud-based systems, etc. Accordingly, the teachings of this disclosure are not intended to be limited to the implementations shown in the figures and/or described herein, but instead have wide applicability.

Figure 1:
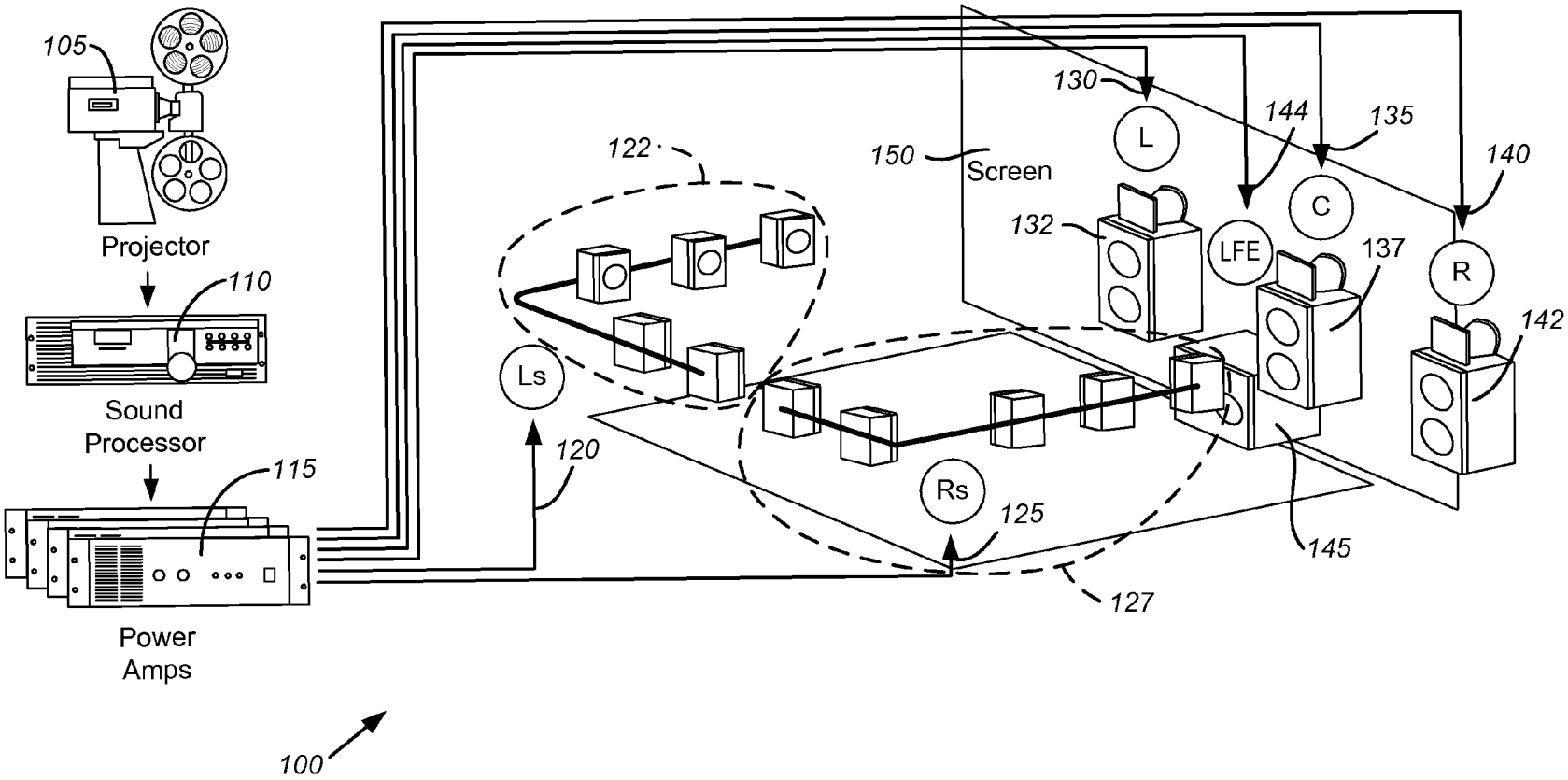
FIG. 1 shows an example of a playback environment having a Dolby Surround 5.1 configuration.

FIG. 1 shows an example of a playback environment having a Dolby Surround 5.1 configuration. In this example, the playback environment is a cinema playback environment. Dolby Surround 5.1 was developed in the 1990s, but this configuration is still widely deployed in home and cinema playback environments. In a cinema playback environment, a projector 105 may be configured to project video images, e.g. for a movie, on a screen 150. Audio data may be synchronized with the video images and processed by the sound processor 110. The power amplifiers 115 may provide speaker feed signals to speakers of the playback environment 100.

The Dolby Surround 5.1 configuration includes a left surround channel 120 for the left surround array 122 and a right surround channel 125 for the right surround array 127. The Dolby Surround 5.1 configuration also includes a left channel 130 for the left speaker array 132, a center channel 135 for the center speaker array 137 and a right channel 140 for the right speaker array 142. In a cinema environment, these channels may be referred to as a left screen channel, a center screen channel and a right screen channel, respectively. A separate low-frequency effects (LFE) channel 144 is provided for the subwoofer 145.

Figure 2:
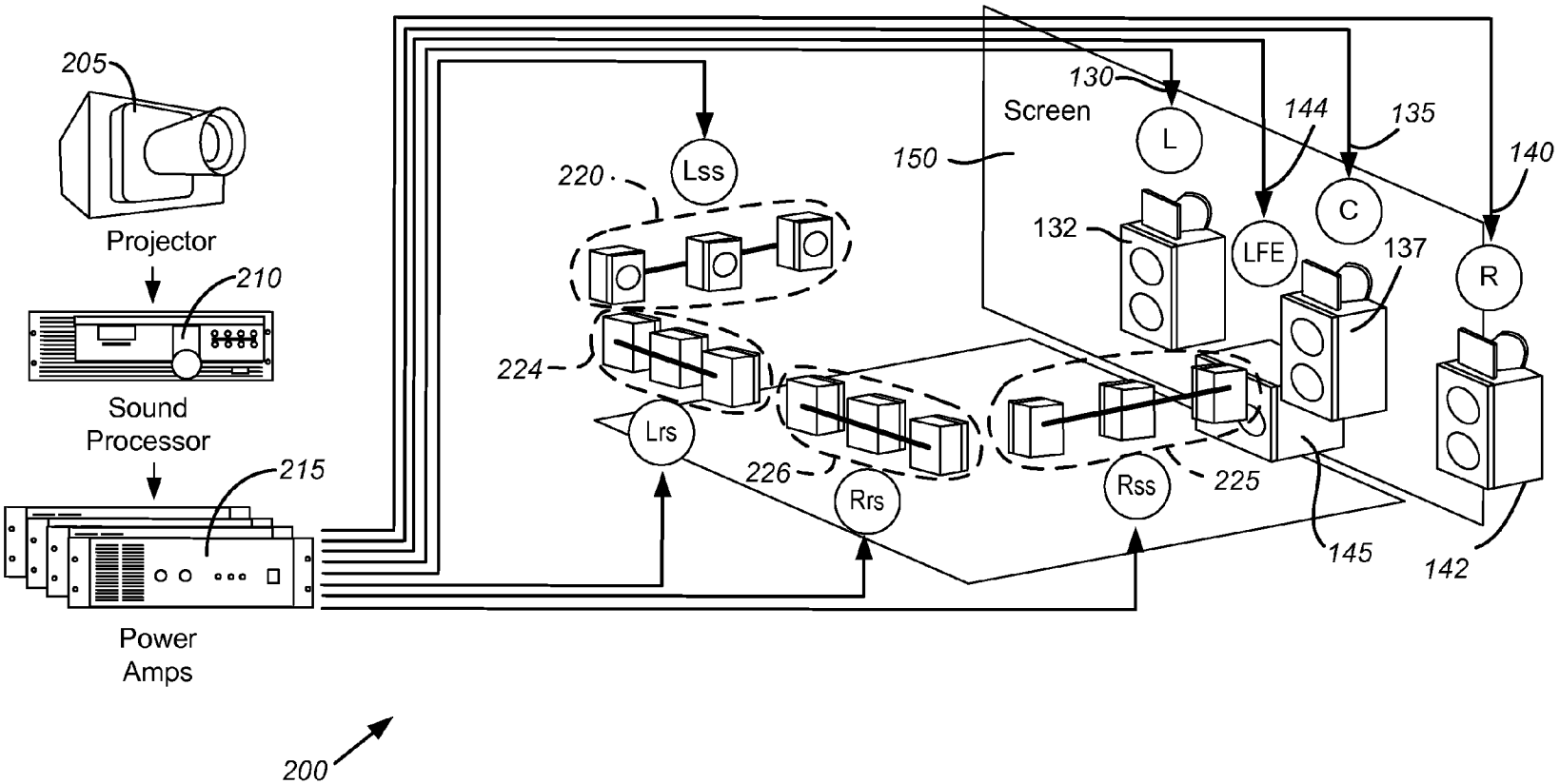
FIG. 2 shows an example of a playback environment having a Dolby Surround 7.1 configuration.

In 2010, Dolby provided enhancements to digital cinema sound by introducing Dolby Surround 7.1. FIG. 2 shows an example of a playback environment having a Dolby Surround 7.1 configuration. A digital projector 205 may be configured to receive digital video data and to project video images on the screen 150. Audio data may be processed by the sound processor 210. The power amplifiers 215 may provide speaker feed signals to speakers of the playback environment 200.

Like Dolby Surround 5.1, the Dolby Surround 7.1 configuration includes a left channel 130 for the left speaker array 132, a center channel 135 for the center speaker array 137, a right channel 140 for the right speaker array 142 and an LFE channel 144 for the subwoofer 145. The Dolby Surround 7.1 configuration includes a left side surround (Lss) array 220 and a right side surround (Rss) array 225, each of which may be driven by a single channel.

However, Dolby Surround 7.1 increases the number of surround channels by splitting the left and right surround channels of Dolby Surround 5.1 into four zones: in addition to the left side surround array 220 and the right side surround array 225, separate channels are included for the left rear surround (Lrs) speakers 224 and the right rear surround (Rrs) speakers 226. Increasing the number of surround zones within the playback environment 200 can significantly improve the localization of sound.

In an effort to create a more immersive environment, some playback environments may be configured with increased numbers of speakers, driven by increased numbers of channels. Moreover, some playback environments may include speakers deployed at various elevations, some of which may be "height speakers" configured to produce sound from an area above a seating area of the playback environment.

Figure 3A:
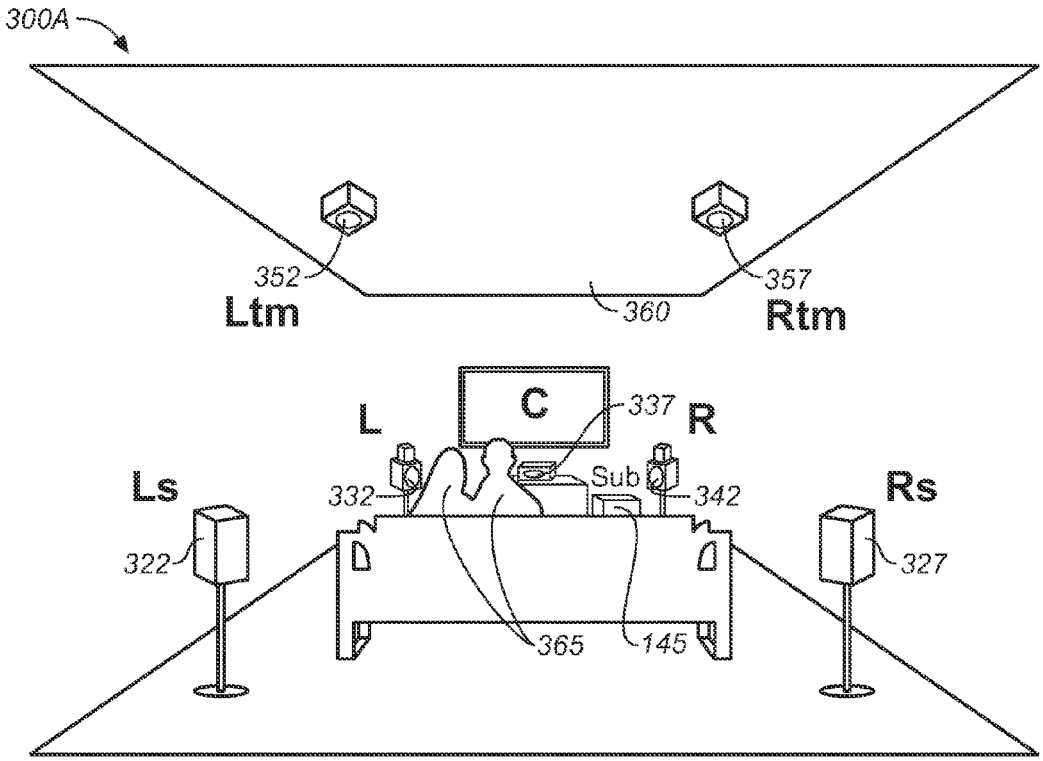
FIGS. 3A and 3B illustrate two examples of home theater playback environments that include height speaker configurations.
Figure 3B:
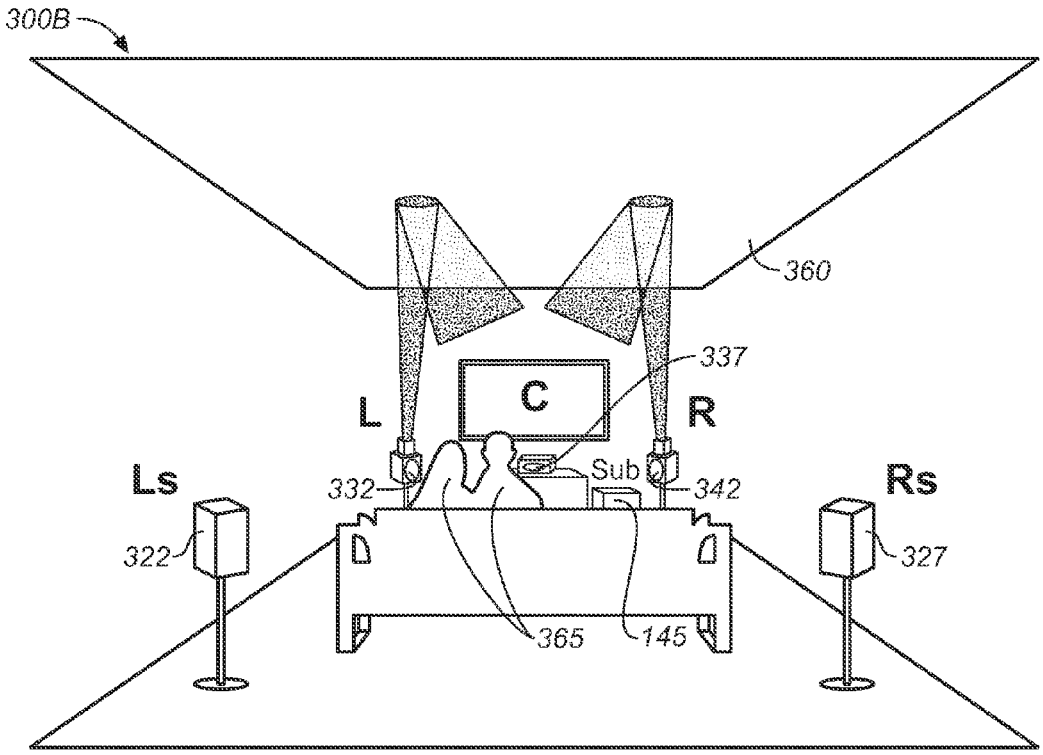

FIGS. 3A and 3B illustrate two examples of home theater playback environments that include height speaker configurations. In these examples, the playback environments 300*a* and 300*b* include the main features of a Dolby Surround 5.1 configuration, including a left surround speaker 322, a right surround speaker 327, a left speaker 332, a right speaker 342, a center speaker 337 and a subwoofer 145. However, the playback environment 300 includes an extension of the Dolby Surround 5.1 configuration for height speakers, which may be referred to as a Dolby Surround 5.1.2 configuration.

FIG. 3A illustrates an example of a playback environment having height speakers mounted on a ceiling 360 of a home theater playback environment. In this example, the playback environment 300*a* includes a height speaker 352 that is in a left top middle (Ltm) position and a height speaker 357 that is in a right top middle (Rtm) position. In the example shown in FIG. 3B, the left speaker 332 and the right speaker 342 are Dolby Elevation speakers that are configured to reflect sound from the ceiling 360. If properly configured, the reflected sound may be perceived by listeners 365 as if the sound source originated from the ceiling 360. However, the number and configuration of speakers is merely provided by way of example. Some current home theater implementations provide for up to 34 speaker positions, and contemplated home theater implementations may allow yet more speaker positions.

Accordingly, the modern trend is to include not only more speakers and more channels, but also to include speakers at differing heights. As the number of channels increases and the speaker layout transitions from 2D to 3D, the tasks of positioning and rendering sounds becomes increasingly difficult.

Accordingly, Dolby has developed various tools, including but not limited to user interfaces, which increase functionality and/or reduce authoring complexity for a 3D audio sound system. Some such tools may be used to create audio objects and/or metadata for audio objects.

Figure 4A:
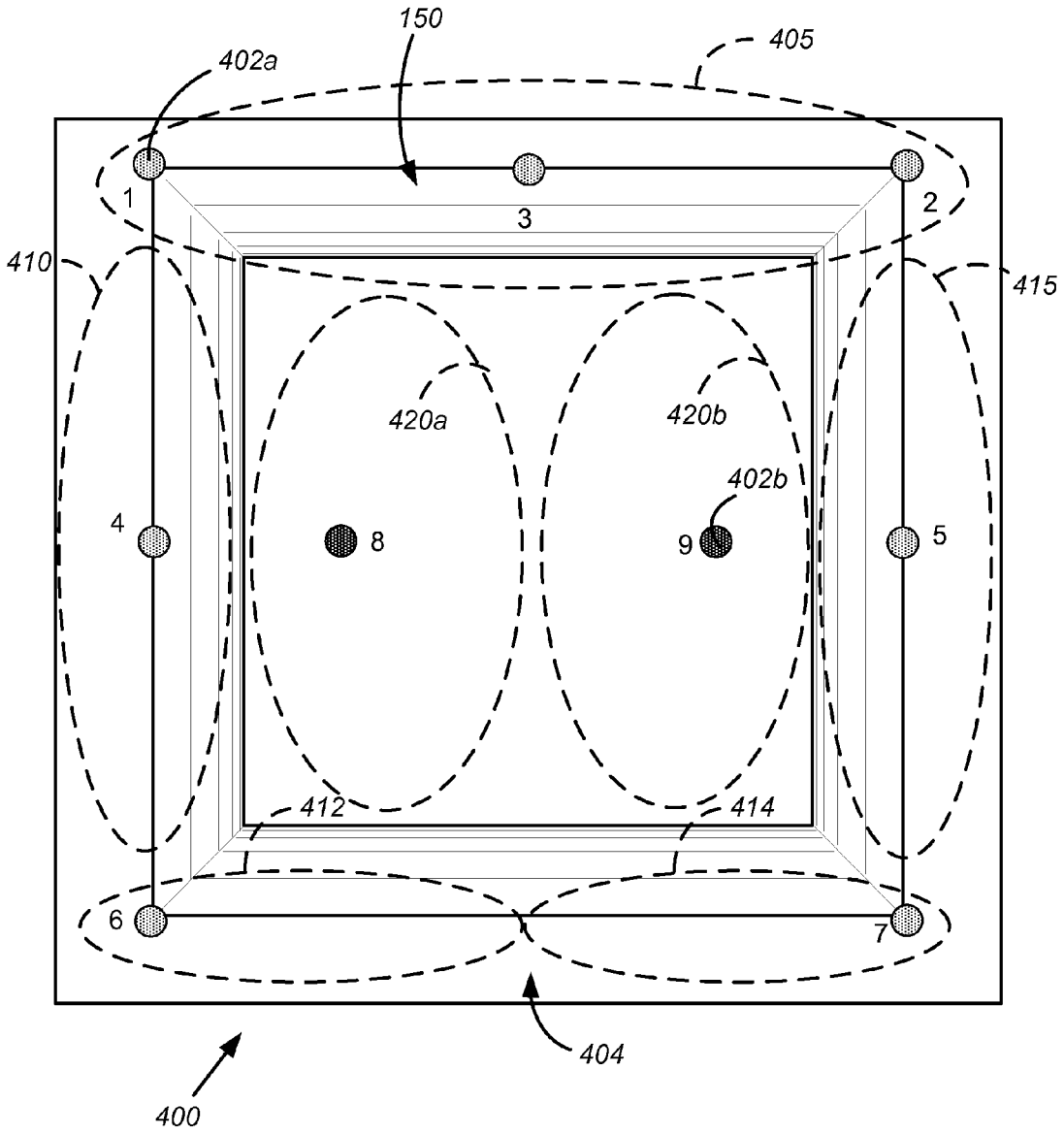
FIG. 4A shows an example of a graphical user interface (GUI) that portrays speaker zones at varying elevations in a virtual playback environment.

FIG. 4A shows an example of a graphical user interface (GUI) that portrays speaker zones at varying elevations in a virtual playback environment. GUI 400 may, for example, be displayed on a display device according to instructions from a logic system, according to signals received from user input devices, etc. Some such devices are described below with reference to FIG. 11.

As used herein with reference to virtual playback environments such as the virtual playback environment 404, the term "speaker zone" generally refers to a logical construct that may or may not have a one-to-one correspondence with a speaker of an actual playback environment. For example, a "speaker zone location" may or may not correspond to a particular speaker location of a cinema playback environment. Instead, the term "speaker zone location" may refer generally to a zone of a virtual playback environment. In some implementations, a speaker zone of a virtual playback environment may correspond to a virtual speaker, e.g., via the use of virtualizing technology such as Dolby Headphone™, (sometimes referred to as Mobile Surround™), which creates a virtual surround sound environment in real time using a set of two-channel stereo headphones. In GUI 400, there are seven speaker zones 402*a* at a first elevation and two speaker zones 402*b* at a second elevation, making a total of nine speaker zones in the virtual playback environment 404. In this example, speaker zones 1-3 are in the front area 405 of the virtual playback environment 404. The front area 405 may correspond, for example, to an area of a cinema playback environment in which a screen 150 is located, to an area of a home in which a television screen is located, etc.

Here, speaker zone 4 corresponds generally to speakers in the left area 410 and speaker zone 5 corresponds to speakers in the right area 415 of the virtual playback environment 404. Speaker zone 6 corresponds to a left rear area 412 and speaker zone 7 corresponds to a right rear area 414 of the virtual playback environment 404. Speaker zone 8 corresponds to speakers in an upper area 420*a* and speaker zone 9 corresponds to speakers in an upper area 420*b*, which may be a virtual ceiling area. Accordingly, the locations of speaker zones 1-9 that are shown in FIG. 4A may or may not correspond to the locations of speakers of an actual playback environment. Moreover, other implementations may include more or fewer speaker zones and/or elevations.

In various implementations described herein, a user interface such as GUI 400 may be used as part of an authoring tool and/or a rendering tool. In some implementations, the authoring tool and/or rendering tool may be implemented via software stored on one or more non-transitory media. The authoring tool and/or rendering tool may be implemented (at least in part) by hardware, firmware, etc., such as the logic system and other devices described below with reference to FIG. 11. In some authoring implementations, an associated authoring tool may be used to create metadata for associated audio data. The metadata may, for example, include data indicating the position and/or trajectory of an audio object in a three-dimensional space, speaker zone constraint data, etc. The metadata may be created with respect to the speaker zones 402 of the virtual playback environment 404, rather than with respect to a particular speaker layout of an actual playback environment. A rendering tool may receive audio data and associated metadata, and may compute audio gains and speaker feed signals for a playback environment. Such audio gains and speaker feed signals may be computed according to an amplitude panning process, which can create a perception that a sound is coming from a position P in the playback environment. For example, speaker feed signals may be provided to speakers 1 through N of the playback environment according to the following equation:

$$x_i(t)=g_i x(t), i=1, \ldots N \quad \text{(Equation 1)}$$

In Equation 1, $x_i(t)$ represents the speaker feed signal to be applied to speaker i, $g_i$ represents the gain factor of the corresponding channel, x(t) represents the audio signal and t represents time. The gain factors may be determined, for example, according to the amplitude panning methods described in Section 2, pages 3-4 of V. Pulkki, *Compensating Displacement of Amplitude-Panned Virtual Sources* (Audio Engineering Society (AES) International Conference on Virtual, Synthetic and Entertainment Audio), which is hereby incorporated by reference. In some implementations, the gains may be frequency dependent. In some implementations, a time delay may be introduced by replacing x(t) by $x(t-\Delta t)$.

In some rendering implementations, audio reproduction data created with reference to the speaker zones 402 may be mapped to speaker locations of a wide range of playback environments, which may be in a Dolby Surround 5.1 configuration, a Dolby Surround 7.1 configuration, a Hamasaki 22.2 configuration, or another configuration. For example, referring to FIG. 2, a rendering tool may map audio reproduction data for speaker zones 4 and 5 to the left side surround array 220 and the right side surround array 225 of a playback environment having a Dolby Surround 7.1 configuration. Audio reproduction data for speaker zones 1, 2 and 3 may be mapped to the left screen channel 230, the right screen channel 240 and the center screen channel 235, respectively. Audio reproduction data for speaker zones 6 and 7 may be mapped to the left rear surround speakers 224 and the right rear surround speakers 226.

Figure 4B:
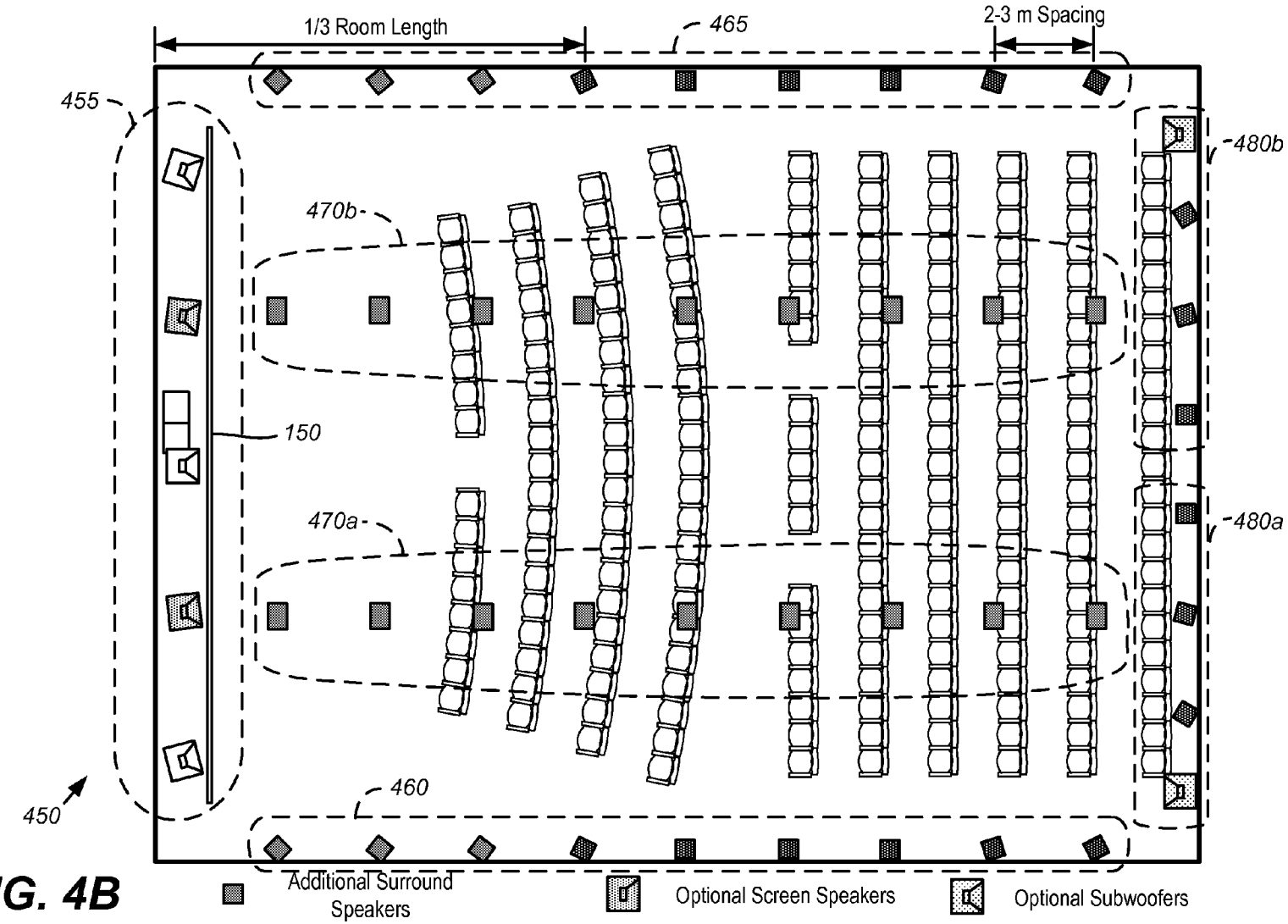
FIG. 4B shows an example of another playback environment.

FIG. 4B shows an example of another playback environment. In some implementations, a rendering tool may map audio reproduction data for speaker zones 1, 2 and 3 to corresponding screen speakers 455 of the playback environment 450. A rendering tool may map audio reproduction data for speaker zones 4 and 5 to the left side surround array 460 and the right side surround array 465 and may map audio reproduction data for speaker zones 8 and 9 to left overhead speakers 470*a* and right overhead speakers 470*b*. Audio reproduction data for speaker zones 6 and 7 may be mapped to left rear surround speakers 480*a* and right rear surround speakers 480*b*.

In some authoring implementations, an authoring tool may be used to create metadata for audio objects. The metadata may indicate the 3D position of the object, rendering constraints, content type (e.g. dialog, effects, etc.) and/or other information. Depending on the implementation, the metadata may include other types of data, such as width data, gain data, trajectory data, etc. Some audio objects may be static, whereas others may move.

Audio objects are rendered according to their associated metadata, which generally includes positional metadata indicating the position of the audio object in a three-dimensional space at a given point in time. When audio objects are monitored or played back in a playback environment, the audio objects are rendered according to the positional metadata using the speakers that are present in the playback environment, rather than being output to a predetermined physical channel, as is the case with traditional, channel-based systems such as Dolby 5.1 and Dolby 7.1.

In addition to positional metadata, other types of metadata may be necessary to produce intended audio effects. For example, in some implementations, the metadata associated with an audio object may indicate audio object size, which may also be referred to as "width." Size metadata may be used to indicate a spatial area or volume occupied by an audio object. A spatially large audio object should be perceived as covering a large spatial area, not merely as a point sound source having a location defined only by the audio object position metadata. In some instances, for example, a large audio object should be perceived as occupying a significant portion of a playback environment, possibly even surrounding the listener.

A cinema sound track may include hundreds of objects, each with its associated position metadata, size metadata and possibly other spatial metadata. Moreover, a cinema sound system can include hundreds of loudspeakers, which may be individually controlled to provide satisfactory perception of audio object locations and sizes. In a cinema, therefore, hundreds of objects may be reproduced by hundreds of loudspeakers, and the object-to-loudspeaker signal mapping consists of a very large matrix of panning coefficients. When the number of objects is given by M, and the number of loudspeakers is given by N, this matrix has up to M*N elements.

The limitations of consumer devices, such as televisions, audio-video receivers (AVRs) and mobile devices, render unfeasible the delivery of the entire soundtrack, with each audio object separate from others, to the consumer device. For example, the audio processing capabilities, disk storage space and bit-rate limitations of a home theater will generally not be on par with those of a cinema sound system. Accordingly, some implementations may involve methods simplifying the audio data provided for a consumer device. Such implementations may involve a "clustering" process that combines data of audio objects that are similar in some respect, for example in terms of spatial location, spatial size, and/or content type. Such implementations may, for example, prevent dialogue from being mixed into a cluster with undesirable metadata, such as a position not near the center speaker, or a large cluster size. Some examples of clustering are described below with reference to FIGS. 5-7B.

Scene Simplification Through Object Clustering

For purposes of the following description, the terms "clustering" and "grouping" or "combining" are used interchangeably to describe the combination of objects and/or beds (channels) to reduce the amount of data in a unit of adaptive audio content for transmission and rendering in an adaptive audio playback system; and the term "reduction" may be used to refer to the act of performing scene simplification of adaptive audio through such clustering of objects and beds. The terms "clustering," "grouping" or "combining" throughout this description are not limited to a strictly unique assignment of an object or bed channel to a single cluster only, instead, an object or bed channel may be distributed over more than one output bed or cluster using weights or gain vectors that determine the relative contribution of an object or bed signal to the output cluster or output bed signal.

In an embodiment, an adaptive audio system includes at least one component configured to reduce bandwidth of object-based audio content through object clustering and perceptually transparent simplifications of the spatial scenes created by the combination of channel beds and objects. An object clustering process executed by the component(s) uses certain information about the objects that may include spatial position, object content type, temporal attributes, object size and/or the like, to reduce the complexity of the spatial scene by grouping like objects into object clusters that replace the original objects.

The additional audio processing for standard audio coding to distribute and render a compelling user experience based on the original complex bed and audio tracks is generally referred to as scene simplification and/or object clustering. The main purpose of this processing is to reduce the spatial scene through clustering or grouping techniques that reduce the number of individual audio elements (beds and objects) to be delivered to the reproduction device, but that still retain enough spatial information so that the perceived difference between the originally authored content and the rendered output is minimized.

The scene simplification process can facilitate the rendering of object-plus-bed content in reduced bandwidth channels or coding systems using information about the objects such as spatial position, temporal attributes, content type, size and/or other appropriate characteristics to dynamically cluster objects to a reduced number. This process can reduce the number of objects by performing one or more of the following clustering operations: (1) clustering objects to objects; (2) clustering object with beds; and (3) clustering objects and/or beds to objects. In addition, an object can be distributed over two or more clusters. The process may use temporal information about objects to control clustering and de-clustering of objects.

In some implementations, object clusters replace the individual waveforms and metadata elements of constituent objects with a single equivalent waveform and metadata set, so that data for N objects is replaced with data for a single object, thus essentially compressing object data from N to 1. Alternatively, or additionally, an object or bed channel may be distributed over more than one cluster (for example, using amplitude panning techniques), reducing object data from N to M, with M<N. The clustering process may use an error metric based on distortion due to a change in location, loudness or other characteristic of the clustered objects to determine a tradeoff between clustering compression versus sound degradation of the clustered objects. In some embodiments, the clustering process can be performed synchronously. Alternatively, or additionally, the clustering process may be event-driven, such as by using auditory scene analysis (ASA) and/or event boundary detection to control object simplification through clustering.

In some embodiments, the process may utilize knowledge of endpoint rendering algorithms and/or devices to control clustering. In this way, certain characteristics or properties of the playback device may be used to inform the clustering process. For example, different clustering schemes may be utilized for speakers versus headphones or other audio drivers, or different clustering schemes may be used for lossless versus lossy coding, and so on.

Figure 5:
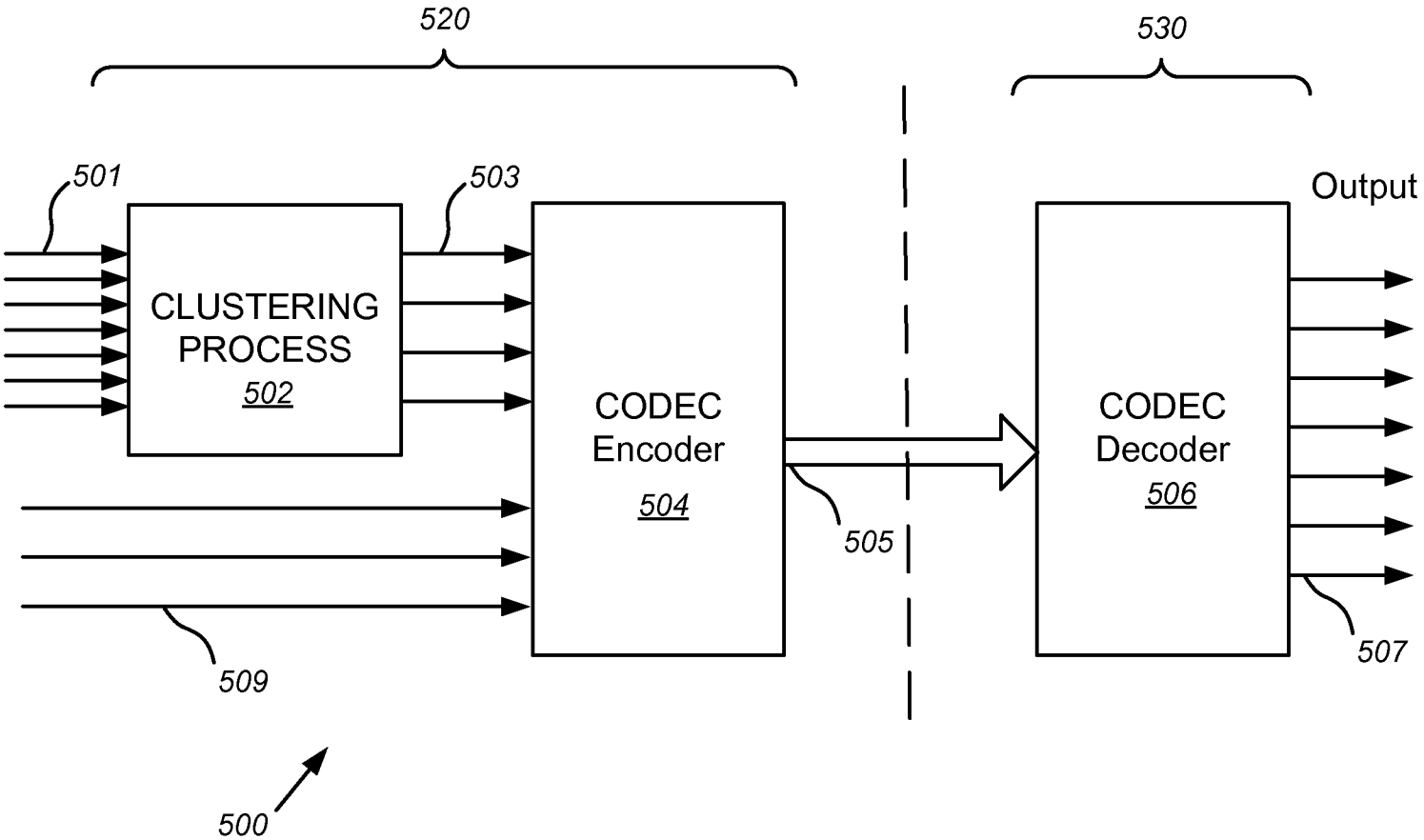
FIG. 5 is a block diagram that shows an example of a system capable of executing a clustering process.

FIG. 5 is a block diagram that shows an example of a system capable of executing a clustering process. As shown in FIG. 5, system 500 includes encoder 504 and decoder 506 stages that process input audio signals to produce output audio signals at a reduced bandwidth. In some implementations, the portion 520 and the portion 530 may be in different locations. For example, the portion 520 may correspond to a post-production authoring system and the portion 530 may correspond to a playback environment, such as a home theater system. In the example shown in FIG. 5, a portion 509 of the input signals is processed through known compression techniques to produce a compressed audio bitstream 505. The compressed audio bitstream 505 may be decoded by decoder stage 506 to produce at least a portion of output 507. Such known compression techniques may involve analyzing the input audio content 509, quantizing the audio data and then performing compression techniques, such as masking, etc., on the audio data itself. The compression techniques may be lossy or lossless and may be implemented in systems that may allow the user to select a compressed bandwidth, such as 192 kbps, 256 kbps, 512 kbps, etc.

In an adaptive audio system, at least a portion of the input audio comprises input signals 501 that include audio objects, which in turn include audio object signals and associated metadata. The metadata defines certain characteristics of the associated audio content, such as object spatial position, object size, content type, loudness, and so on. Any practical number of audio objects (e.g., hundreds of objects) may be processed through the system for playback. To facilitate accurate playback of a multitude of objects in a wide variety of playback systems and transmission media, system 500 includes a clustering process or component 502 that reduces the number of objects into a smaller, more manageable number of objects by combining the original objects into a smaller number of object groups.

The clustering process thus builds groups of objects to produce a smaller number of output groups 503 from an original set of individual input objects 501. The clustering process 502 essentially processes the metadata of the objects as well as the audio data itself to produce the reduced number of object groups. The metadata may be analyzed to determine which objects at any point in time are most appropriately combined with other objects, and the corresponding audio waveforms for the combined objects may be summed together to produce a substitute or combined object. In this example, the combined object groups are then input to the encoder 504, which is configured to generate a bitstream 505 containing the audio and metadata for transmission to the decoder 506.

In general, the adaptive audio system incorporating the object clustering process 502 includes components that generate metadata from the original spatial audio format. The system 500 comprises part of an audio processing system configured to process one or more bitstreams containing both conventional channel-based audio elements and audio object coding elements. An extension layer containing the audio object coding elements may be added to the channel-based audio codec bitstream or to the audio object bitstream. Accordingly, in this example the bitstreams 505 include an extension layer to be processed by renderers for use with existing speaker and driver designs or next generation speakers utilizing individually addressable drivers and driver definitions.

The spatial audio content from the spatial audio processor may include audio objects, channels, and position metadata. When an object is rendered, it may be assigned to one or more speakers according to the position metadata and the location of the playback speakers. Additional metadata, such as size metadata, may be associated with the object to alter the playback location or otherwise limit the speakers that are to be used for playback. Metadata may be generated in the audio workstation in response to the engineer's mixing inputs to provide rendering cues that control spatial parameters (e.g., position, size, velocity, intensity, timbre, etc.) and specify which driver(s) or speaker(s) in the listening environment play respective sounds during exhibition. The metadata may be associated with the respective audio data in the workstation for packaging and transport by spatial audio processor.

Figure 6:
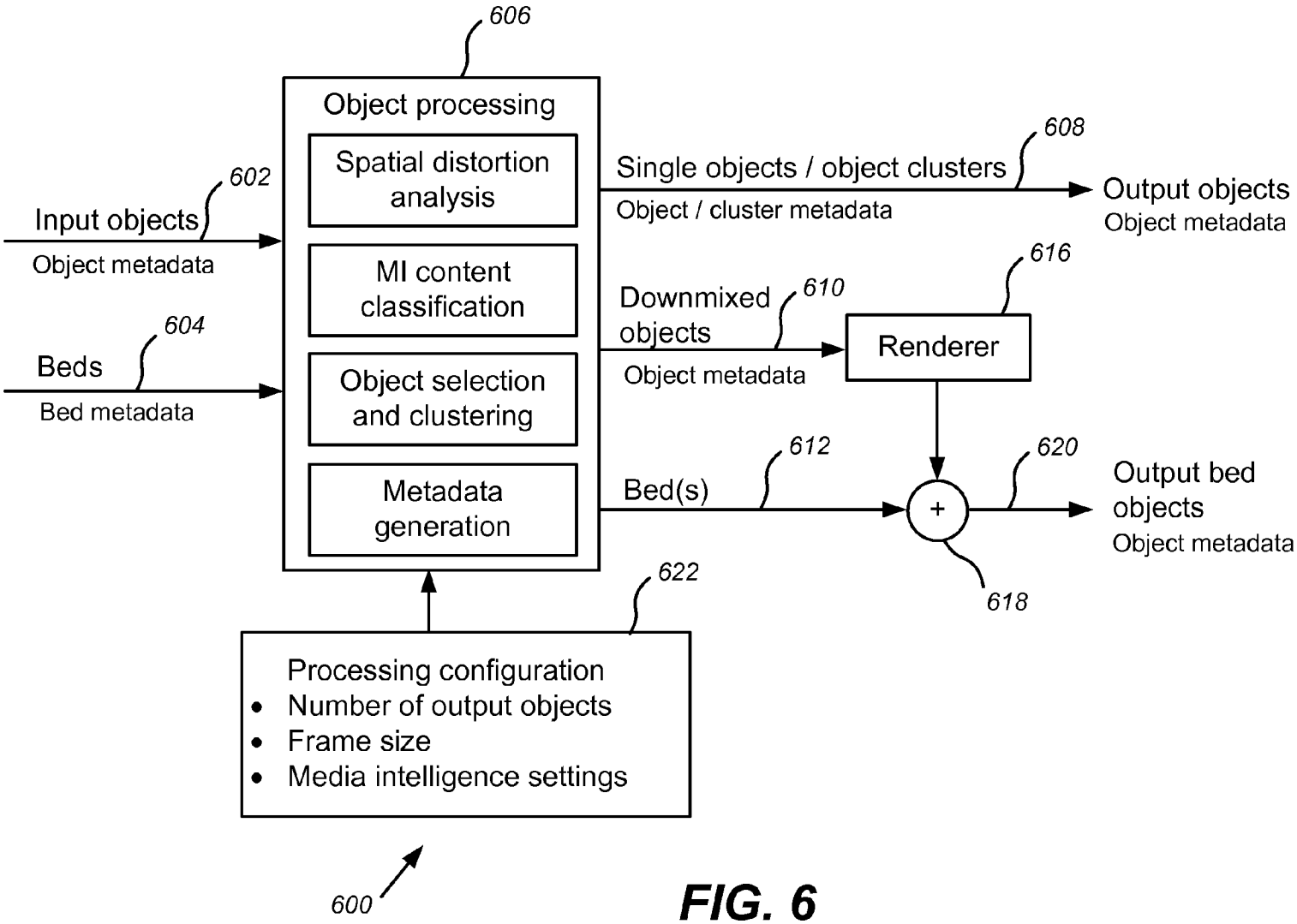
FIG. 6 is a block diagram that illustrates an example of a system capable of clustering objects and/or beds in an adaptive audio processing system.

FIG. 6 is a block diagram that illustrates an example of a system capable of clustering objects and/or beds in an adaptive audio processing system. In the example shown in FIG. 6, an object processing component 606, which is capable of performing scene simplification tasks, reads in an arbitrary number of input audio files and metadata. The input audio files comprise input objects 602 and associated object metadata, and may include beds 604 and associated bed metadata. This input file/metadata thus correspond to either "bed" or "object" tracks.

In this example, the object processing component 606 is capable of combining media intelligence/content classification, spatial distortion analysis and object selection/clustering information to create a smaller number of output objects and bed tracks. In particular, objects can be clustered together to create new equivalent objects or object clusters 608, with associated object/cluster metadata. The objects can also be selected for downmixing into beds. This is shown in FIG. 6 as the output of downmixed objects 610 input to a renderer 616 for combination 618 with beds 612 to form output bed objects and associated metadata 620. The output bed configuration 620 (e.g., a Dolby 5.1 configuration) does not necessarily need to match the input bed configuration, which for example could be 9.1 for Atmos cinema. In this example, new metadata are generated for the output tracks by combining metadata from the input tracks and new audio data are also generated for the output tracks by combining audio from the input tracks.

In this implementation, the object processing component 606 is capable of using certain processing configuration information 622. Such processing configuration information 622 may include the number of output objects, the frame size and certain media intelligence settings. Media intelligence can involve determining parameters or characteristics of (or associated with) the objects, such as content type (i.e., dialog/music/effects/etc.), regions (segment/classification), preprocessing results, auditory scene analysis results, and other similar information. For example, the object processing component 606 may be capable of determining which audio signals correspond to speech, music and/or special effects sounds. In some implementations, the object processing component 606 is capable of determining at least some such characteristics by analyzing audio signals. Alternatively, or additionally, the object processing component 606 may be capable of determining at least some such characteristics according to associated metadata, such as tags, labels, etc.

In an alternative embodiment, audio generation could be deferred by keeping a reference to all original tracks as well as simplification metadata (e.g., which objects belongs to which cluster, which objects are to be rendered to beds, etc.). Such information may, for example, be useful for distributing functions of a scene simplification process between a studio and an encoding house, or other similar scenarios.

In view of the foregoing description, it will be apparent that each cluster may receive a combination of audio signals and metadata from a number of audio objects. The contribution of each audio object's properties may be determined by a rule set. Such a rule set may be thought of as a panning algorithm. In this context, the panning algorithm may produce, for every audio object, a set of signals corresponding to each cluster, given each audio object's audio signals and metadata, and each cluster's position. A point that represents a cluster's position may be referred to herein as a "cluster centroid."

In principle, it could be possible to use various panning algorithms to compute the contribution of audio objects to each cluster. However, some panning algorithms that are very useful for static speaker layouts may not be optimal for determining the contribution of audio object properties to clusters. One reason is that, unlike speaker layouts in a playback environment, cluster centroid positions are often time-varying and may be highly time-varying.

Figure 7A:
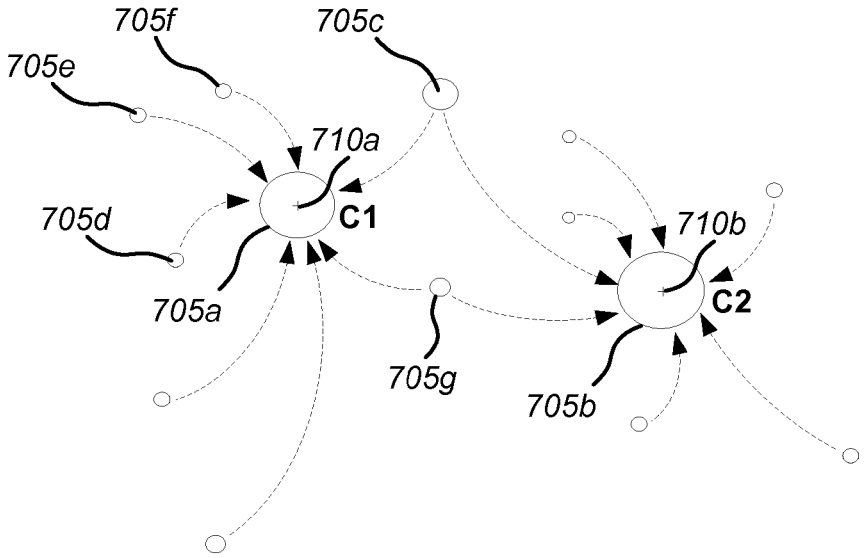
FIGS. 7A and 7B depict the contributions of audio objects to clusters at two different times.
Figure 7B:
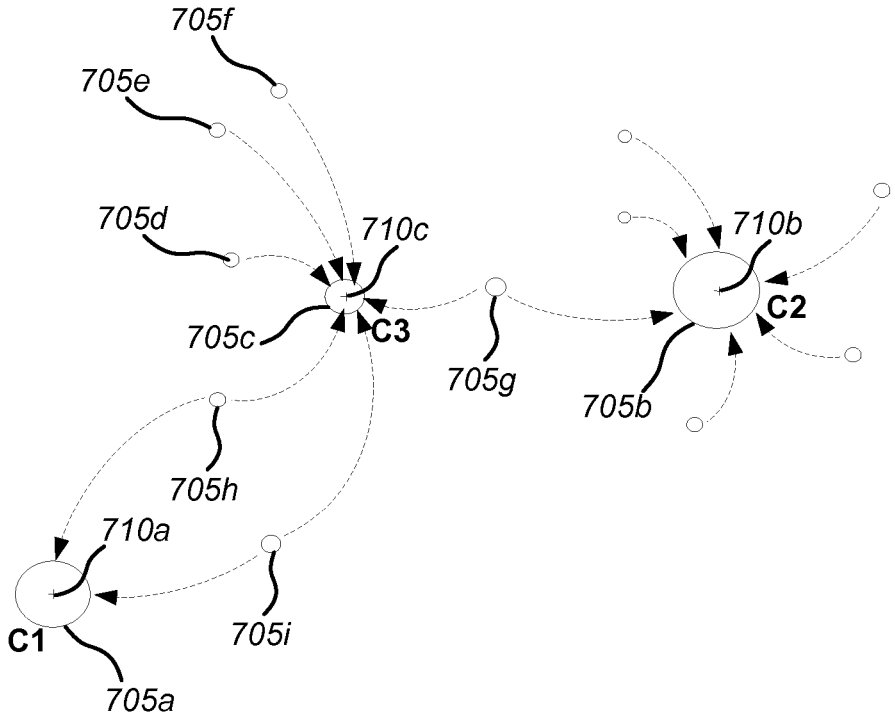

FIGS. 7A and 7B depict the contributions of audio objects to clusters at two different times. In FIGS. 7A and 7B, each ellipse represents an audio object. The size of each ellipse corresponds with the amplitude or "loudness" of the audio signal for the corresponding audio object. Although only 14 audio objects are shown in FIG. 7A, these audio object may be only a portion of the audio objects involved in a scene at the time represented by FIG. 7A. At this instant in time, a clustering process (such as described above) has determined that the 14 audio objects shown in FIG. 7A will be grouped into two clusters, which are labeled C1 and C2 in FIG. 7A.

The clustering process has selected audio objects 710*a* and 710*b* as being the most representative audio objects for the two clusters. In this example, audio objects 710*a* and 710*b* were selected because their corresponding audio data had the highest amplitude, as compared to other nearby audio objects. Accordingly, as indicated by the dashed arrows, audio data from nearby audio objects, including that of audio object 705*c*, will be combined with that of audio objects 710*a* and 710*b* to form the resulting audio signals of clusters C1 and C2. In this example, the cluster centroid 710*a*, which corresponds to the position of cluster C1, is deemed to have the same position as that of audio object 710*a*. The cluster centroid 710*b*, which corresponds to the position of cluster C2, is deemed to have the same position as that of audio object 710*b*.

However, at the time represented by FIG. 7B, several of the audio objects, including audio objects 710*a* and 710*c*, have changed position relative to the configuration shown in FIG. 7A. At the instant in time represented by FIG. 7B, the clustering process has determined that the 14 audio objects shown in FIG. 7B will be grouped into three clusters. Given the new positions of audio objects 710*a* and 710*c*, audio object 705*c* is now deemed to be the most representative of nearby audio objects, including audio objects 705*d*, 705*e*, 705*f* and 705*g*. Therefore, the audio data for audio objects 705*d*, 705*e*, 705*f* and 705*g* will now contribute to the resulting audio signals of cluster C3. Only audio objects 705*h* and 705*i* continue to contribute to the resulting audio signals of cluster C1.

Some panning algorithms require the generation of a geometrical structure, based on speaker positions. For example, vector-based amplitude panning (VBAP) algorithms require a triangulation of a convex hull defined by the speaker positions. Because clusters' positions, unlike speaker layouts, are often time-varying, using a geometrical-structure-based panning algorithm to render audio data corresponding to moving clusters would require a re-computation of the geometrical structures (such as the triangles used by VBAP algorithms) at very high time rate, which could require a significant computational burden. Accordingly, using such algorithms to render audio data corresponding to moving clusters may not be optimal for consumer devices. Moreover, even if computational cost were not a problem, the use of a geometrical-structure-based panning algorithm to render audio data corresponding to moving clusters can lead to discontinuities in the results, due to cluster movement: as clusters move, different geometrical structures may need to be selected for the panning algorithm. The change of structure is a discrete change, which can happen even if the clusters' motion is small.

Even panning algorithms that do not require geometrical structure may not be convenient for rendering audio data corresponding to moving clusters. Some panning algorithms, such as distance-based amplitude panning (DBAP), are not optimal when there are large variations in the spatial density of speakers. In speaker layouts wherein some regions of the space surrounding the listeners are densely covered by speakers and other regions of the space include sparse speaker distributions, the panning algorithm should take this fact into account. Otherwise, audio objects tend to be perceived as located in the areas that are densely covered by speakers, simply due to the fact that the largest fraction of energy tends to be concentrated there. This issue can become more challenging in the context of rendering to clusters, because clusters often move in space and can create significant variations in spatial density.

Moreover, the process of dynamically selecting a subset of clusters that will participate of the rendering of audio objects does not always produce continuous results even when continuous variations of the audio objects' metadata occur. One reason for potential discontinuities is that the selection process is discrete. As shown in FIGS. 7A and 7B, for example, even smooth movements of one or more audio objects (such as audio objects 705*a* and 705*c*) may cause the audio contributions of other audio objects to be "re-assigned" to another cluster.

Some implementations provided herein involve methods for panning audio objects to arbitrary layouts of speakers or clusters. Some such implementations do not require the use of a geometrical-structure-based panning algorithm. The methods disclosed herein may produce continuous results when an audio object's metadata changes continuously and/or when cluster positions change continuously. According to some such implementations, small changes in cluster positions and/or audio object positions will result in small changes in the computed gains. Some such methods compensate for variations of speaker density or cluster density. Although the disclosed methods may be suitable for rendering audio data corresponding to clusters, which may have time-varying positions, such methods also may be used for rendering audio data to physical speakers having arbitrary layouts.

According to some implementations disclosed herein, the gain computation of a panning algorithm is based on a a concept of center of loudness (CL), which is conceptually similar to the concept of center of mass. According to some such implementations, a panning algorithm will determine gains for speakers or clusters such that the center of loudness matches (or substantially matches) the audio object's position.

Figure 8A:
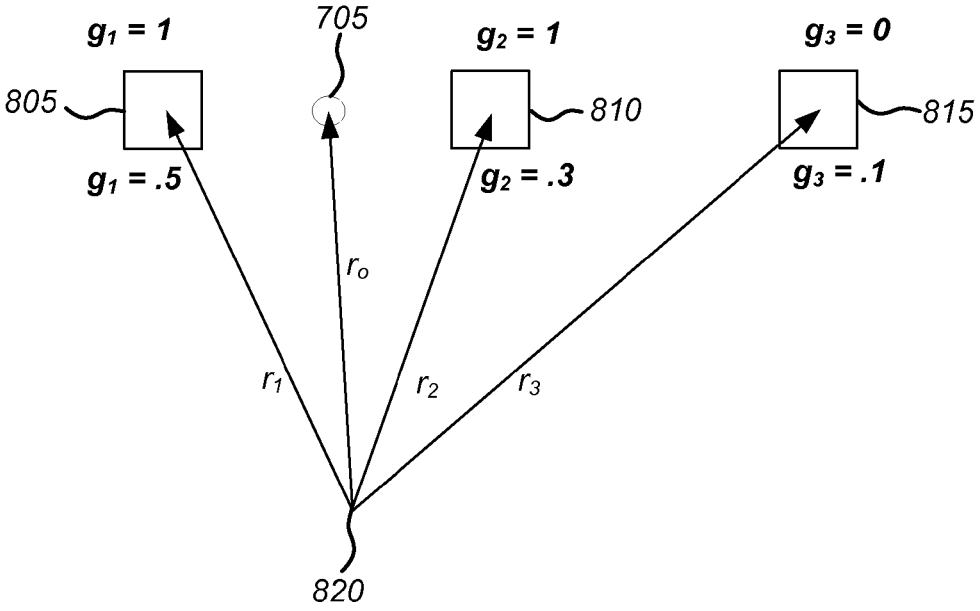
FIGS. 8A and 8B show examples of determining gains that correspond to an audio object.
Figure 8B:
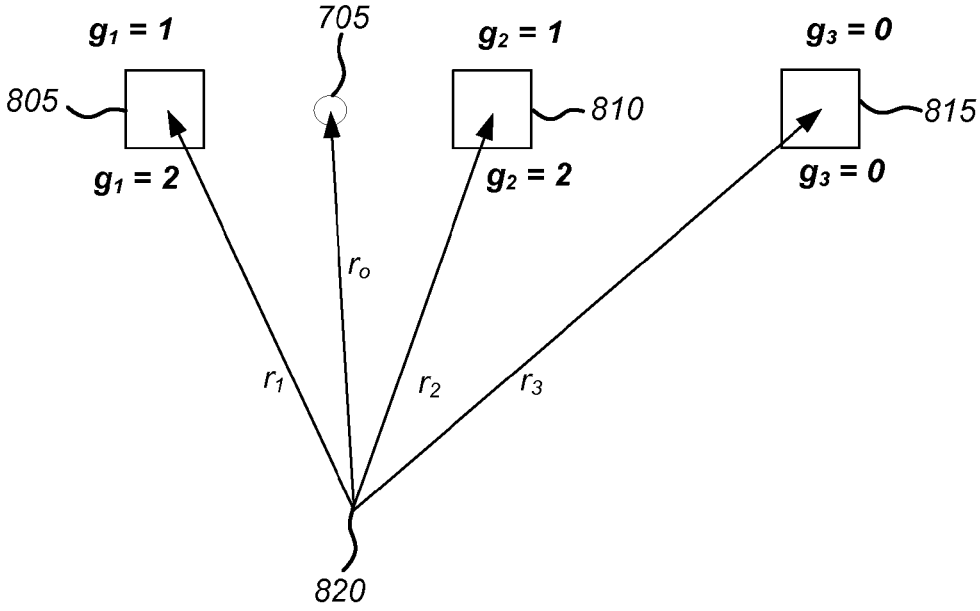

FIGS. 8A and 8B show examples of determining gains that correspond to an audio object. Although the discussion in these examples is primaly focused on determining gains for speakers, the same general concepts apply to determining gains for clusters. FIGS. 8A and 8B depict an audio object 705 and speakers 805, 810 and 815. In this example, the audio object 705 is positioned midway between speakers 805 and 810. Here, the position of the audio object 705 in 3D space is shown as position $\vec{r}_o$, with reference to a point of origin 820.

The position of the center of loudness may be determined as:

$$\vec{r}_{CL} = \sum_i g_i \vec{r}_i \Big/ \sum_i g_i \qquad \text{(Equation 2)}$$

In Equation 2, $\vec{r}_{CL}$ represents the position of the center of loudness, $\vec{r}_i$ represents the position of speaker i and $g_i$ represents the gain of speaker i.

The positions of the speakers 805, 810 and 815 are shown in FIGS. 8A and 8B as $\vec{r}_1$, $\vec{r}_2$, and $\vec{r}_3$, respectively. Accordingly, in the example shown in FIGS. 8A and 8B, the position of the center of loudness may be determined as $[(g_1\vec{r}_1)+(g_2\vec{r}_2)+(g_3\vec{r}_3)]/[g_1+g_2+g_3]$, wherein $g_1$, $g_2$ and $g_3$ represent the gains of the speakers 805, 810 and 815, respectively.

Some implementations involve selecting gains such that $\vec{r}_{CL}$ matches, or substantially matches, $\vec{r}_o$. For example, referring to Equation 2, some methods may involve choosing $g_i$ such that $\vec{r}_{CL}=\vec{r}_o$. Such methods have positive attributes. For example, if $\vec{r}_{CL}$ coincides with a speaker location, in some such implementations a gain is assigned only to that speaker. If $\vec{r}_{CL}$ is on a line between multiple speaker locations, in some such implementations a gain is assigned only to the speakers along that line.

Some implementations include additional advantageous rules. For example, some implementations include rules to eliminate non-unique solutions.

Some such rules may involve minimizing the number of speakers (or clusters) for which a gain will be determined. Referring again to FIG. 8A, two examples of gains are shown for each of the speakers 805, 810 and 815. Because the audio object 705 is midway between speakers 805 and 810, setting $g_1$ and $g_2$ to the same value while setting $g_3=0$ will make $\vec{r}_{CL}=\vec{r}_o$. In this example, $g_1$ and $g_2$ are set to 1. However, there are various other combinations of gains that can also make $\vec{r}_{CL}=\vec{r}_o$. One such example is also shown in FIG. 8A: in the second example shown in this figure, $g_1=0.5$, $g_2=0.3$ and $g_3=0.1$.

Accordingly, some implementations may involve rules that penalize applying gains to speakers (or clusters) that are farther from an audio object. As between the two scenarios described above, for example, such implementations would favor setting $g_1$ and $g_2$ to 1 while setting $g_3=0$ to make $\vec{r}_{CL}=\vec{r}_o$.

Such rules can eliminate some, but not all, non-unique solutions. As shown in FIG. 8B, for example, even if a rule is applied that penalizes applying gains to speakers (or clusters) that are farther from an audio object and $g_1$ and $g_2$ are set to the same value while setting $g_3=0$, there would still be an infinite number of values of $g_1$ and $g_2$ that would make $\vec{r}_{CL}=\vec{r}_o$. Therefore, in some implementations a scaling factor is applied the gains in order to select a single solution among many non-unique solutions.

In some implementations, the foregoing rules (and possibly other rules) of a panning algorithm may be implemented via a cost function. The cost function may be based on an audio object's position, speaker (or cluster) positions and corresponding gains. The panning algorithm may involve minimizing the cost function with respect to the gains. According to some examples, a primary term in the cost function represents the difference between the center of loudness position and an audio object position (between $\vec{r}_{CL}$ and $\vec{r}_o$). The cost function may include a "regularization" term that distinguishes and selects a solution from among many possible solutions. For example, the regularization term may penalize applying gains to speakers (or clusters) that are relatively farther from an audio object.

Figure 9:
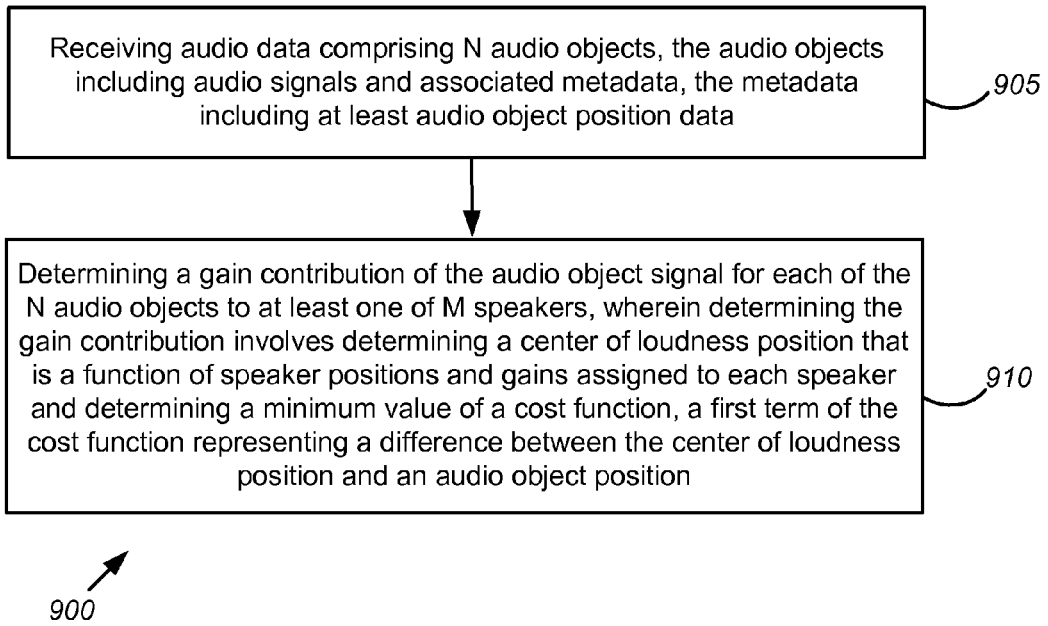
FIG. 9 is a flow diagram that provides an overview of some methods of rendering audio objects to speaker locations.

FIG. 9 is a flow diagram that provides an overview of some methods of rendering audio objects to speaker locations. The operations of method 900, as with other methods described herein, are not necessarily performed in the order indicated. Moreover, these methods may include more or fewer blocks than shown and/or described. These methods may be implemented, at least in part, by a logic system such as those shown in FIGS. 10E and 11, and described below. Such a logic system may be a component of an audio processing system. Alternatively, or additionally, such methods may be implemented via a non-transitory medium having software stored thereon. The software may include instructions for controlling one or more devices to perform, at least in part, the methods described herein.

In this example, method 900 begins with block 905, which involves receiving audio data including N audio objects. The audio data may, for example, be received by an audio processing system. In this example, the audio objects include audio signals and associated metadata. The metadata may include various types of metadata, such as described elsewhere herein, but includes at least audio object position data in this example.

Here, block 910 involves determining a gain contribution of the audio object signal for each of the N audio objects to at least one of M speakers. In this example, determining the gain contribution involves determining a center of loudness position that is a function of speaker positions and gains assigned to each speaker. Here, determining the gain contribution involves determining a minimum value of a cost function. In this example, a first term of the cost function represents a difference between the center of loudness position and an audio object position.

According to some implementations, determining the center of loudness position may involve combining speaker positions via a weighting process in which a weight applied to a speaker position corresponds to a gain assigned to the speaker position. In some such implementations, the first term of the cost function may be as follows:

$$E_{CL} = \left[\left(\sum_i g_i\right)\vec{r}_o - \sum_i g_i\vec{r}_i\right]^2 \quad \text{(Equation 3)}$$

In Equation 3, $E_{CL}$ represents the error between the center of loudness and the audio object's position. Accordingly, in some implementations, determining the center of loudness position may involve: determining products of each speaker position and a gain assigned to each corresponding speaker; calculating a sum of the products; determining a sum of the gains for all speakers; and dividing the sum of the products by the sum of the gains.

As noted above, in some implementations a second term of the cost function represents a distance between the object position and a speaker position. According to some such implementations, the second term of the cost function is proportional to a square of the distance between the audio object position and a speaker position. Accordingly, the second term of the cost function may involve a penalty for applying gains to speakers that are relatively farther from the source. This term can allow the cost function to discriminate between the options noted above with reference to FIG. 8A, for example. In some such implementations, the second term of the cost function may be as follows:

$$E_{distance} = \alpha_{distance}\sum_i g_i^2(\vec{r}_o - \vec{r}_i)^2 \quad \text{(Equation 4)}$$

In Equation 4, $E_{distance}$ represents a penalty for applying gains to speakers that are relatively farther from the source and $\alpha_{distance}$ represents a distance weighting factor. $E_{distance}$ is an example of the regularization term described above. In some implementations, the weighting factor $\alpha_{distance}$ may between 0.1 and 0.001. In one example, is $\alpha_{distance}=0.01$.

In some implementations, a third term of the cost function may set a scale for determined gain contributions. This term can allow the cost function to discriminate between the options noted above with reference to FIG. 8B, for example, and to select a single set of gains from a potentially infinite number of gain sets. In some such implementations, the third term of the cost function may be as follows:

$$E_{sum\text{-}to\text{-}one} = \alpha_{sum\text{-}to\text{-}one}\left[\sum_i g_i - 1\right]^2. \quad \text{(Equation 5)}$$

In Equation 5, $E_{sum\text{-}to\text{-}one}$ represents a term that sets the scale of the gains and $\alpha_{sum\text{-}to\text{-}one}$ represents a scaling factor for gain contributions. In some examples, $\alpha_{sum\text{-}to\text{-}one}$ may be set to 1. However, in other examples, $\alpha_{sum\text{-}to\text{-}one}$ may be set to another value, such as 2 or another positive number.

In some implementations, the cost function may be a quadratic function of the gains assigned to each speaker. In some such implementations, the quadratic function may include the first, second and third terms noted above, e.g. as follows:

$$E[g_i]=E_{CL}+E_{distance}+E_{sum\text{-}to\text{-}one} \quad \text{(Equation 6)}$$

In Equation 6, $E[g_i]$ represents a cost function that is quadratic in $g_i$. Implementations involving quadratic cost functions can have potential advantages. For example, minimizing the cost function is generally straightforward (analytic). Moreover, with a quadratic cost function there is only one minimum value. However, alternative implementations may use non-quadratic cost functions, such as higher-order cost functions. Although these alternative implementations have some potential benefits, minimizing the cost function may not be as straightforward, as compared to the minimization process for a quadratic cost function. Moreover, with a higher-order cost function, there is generally more than one minimum value. It may be challenging to determine a global minimum for a higher-order cost function.

Some implementations involve a process of tuning the gains that result from applying a cost function to ensure volume preservation, in other words to ensure that an audio object is perceived with the same volume/loudness in any arbitrary speaker layout. There are various possibilities. In some implementations, the gains may be normalized such that:

$$g_i^{normalized} = g_i \Big/ \left(\sum_j g_j^p\right)^{1/p} \quad \text{(Equation 7)}$$

In Equation 7, $g_i^{normalized}$ represents a normalized speaker (or cluster) gain and p represents a constant. In some examples, p may be in the range [1,2].

Although the foregoing discussion of using a cost function to determine gain contributions has been described primarily in terms of rendering to speakers, such methods can be particularly useful for determining gain contributions of clusters, which may be time-varying clusters.

Figure 10A:
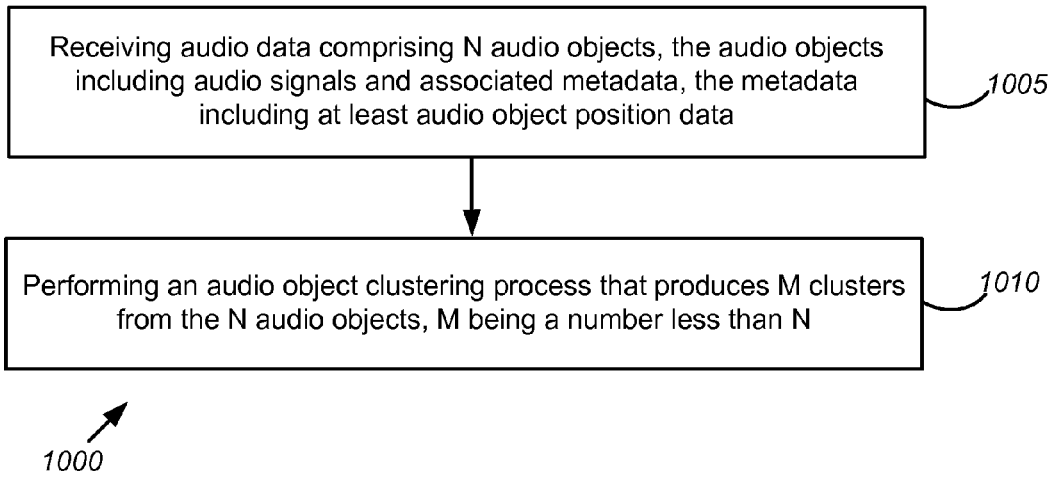
FIGS. 10A and 10B are flow diagrams that provide an overview of some methods of rendering audio objects to clusters.
Figure 10B:
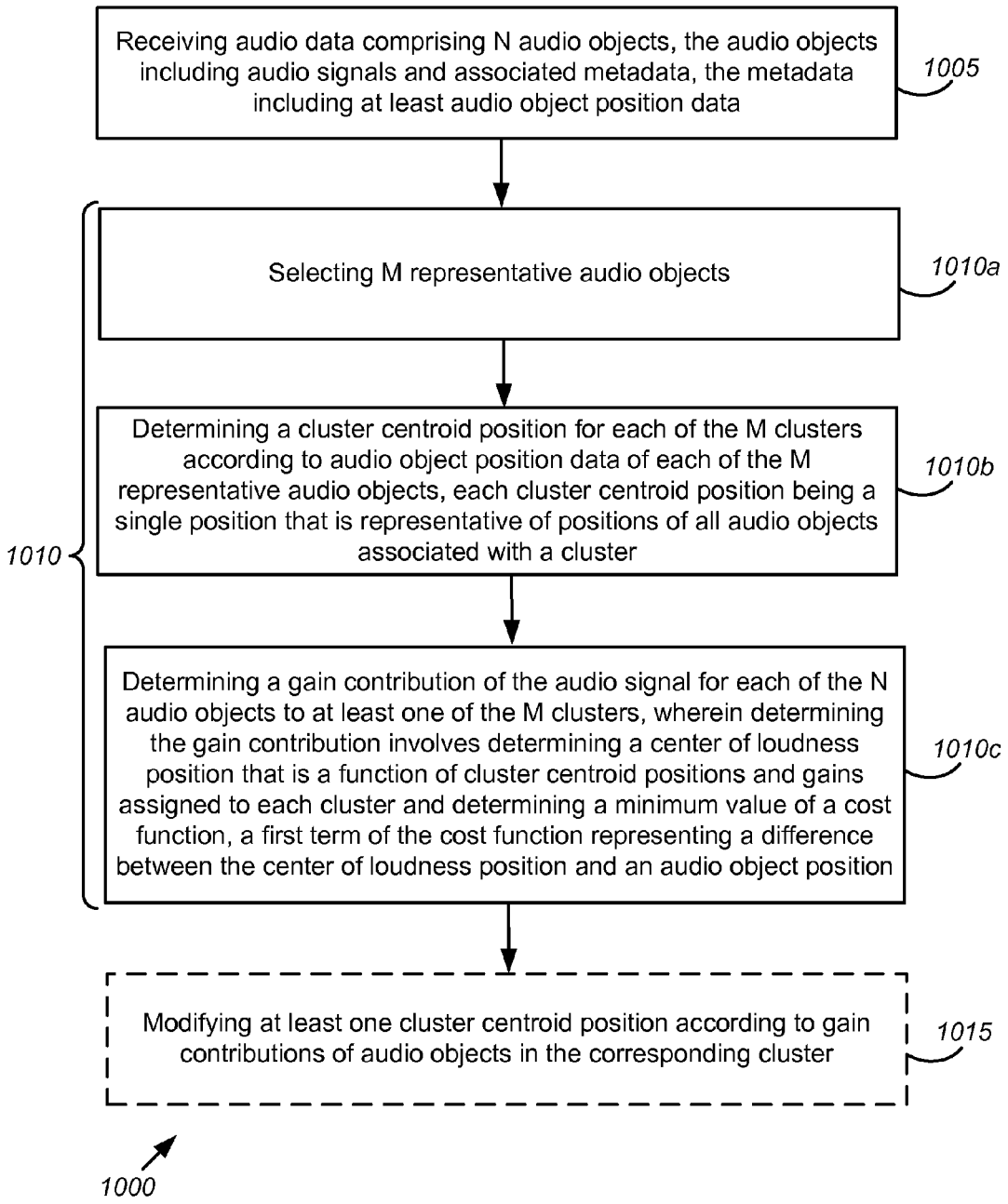

FIGS. 10A and 10B are flow diagrams that provide an overview of some methods of rendering audio objects to clusters. The operations of method 1000, as with other methods described herein, are not necessarily performed in the order indicated. Moreover, these methods may include more or fewer blocks than shown and/or described. These methods may be implemented, at least in part, by a logic system such as those shown in FIGS. 10E and 11, and described below. Such a logic system may be a component of an audio processing system. Alternatively, or additionally, such methods may be implemented via a non-transitory medium having software stored thereon. The software may include instructions for controlling one or more devices to perform, at least in part, the methods described herein.

In this example, method 1000 begins with block 1005, which involves receiving audio data including N audio objects. The audio data may, for example, be received by an audio processing system. In this example, the audio objects include audio signals and associated metadata. The metadata may include various types of metadata, such as described elsewhere herein, but includes at least audio object position data in this example. In this example, block 1010 involves performing an audio object clustering process that produces M clusters from the N audio objects, M being a number less than N.

FIG. 10B shows one example of the details of block 1010. In this example, block 1010*a* involves selecting M representative audio objects. As described elsewhere herein, the representative audio objects may be selected according to various criteria, depending on the particular implementation. As described above with reference to FIGS. 7A and 7B, for example, one such criterion may be the amplitude of the audio signal for each audio object: relatively "louder" audio objects may be selected as representatives in block 1010*a*.

Here block 1010*b* involves determining a cluster centroid position for each of the M clusters according to audio object position data of each of the M representative audio objects. Here, each cluster centroid position is a single position that is representative of positions of all audio objects associated with a cluster. In this example, each cluster centroid position corresponds to a position of one of the M representative audio objects.

In this example, block 1010*c* involves determining a gain contribution of the audio signal for each of the N audio objects to at least one of the M clusters. Here, determining the gain contribution involves determining a center of loudness position that is a function of cluster centroid positions and gains assigned to each cluster and determining a minimum value of a cost function. In this implementation, a first term of the cost function represents a difference between the center of loudness position and an audio object position.

Accordingly, the process of determining gain contributions to each of the M clusters may be performed substantially as described above in the context of determining gain contributions to each of M speakers. The process may differ in some respects, however, because the cluster centroid positions may be time-varying and speaker positions of a playback environment will generally not be time-varying.

Therefore, in some implementations, determining the center of loudness position may involve combining cluster centroid positions via a weighting process in which a weight applied to a cluster centroid position corresponds to a gain assigned to the cluster centroid position. For example, determining the center of loudness position may involve: determining products of each cluster centroid position and a gain assigned to each cluster centroid position; calculating a sum of the products; determining a sum of the gains for all cluster centroid positions; and dividing the sum of the products by the sum of the gains.

In some examples, a second term of the cost function represents a distance between the object position and a cluster centroid position. For example, the second term of the cost function may be proportional to a square of the distance between the object position and a cluster centroid position. In some implementations, a third term of the cost function may set a scale for determined gain contributions. The cost function may be a quadratic function of the gains assigned to each cluster.

In this example, optional block 1015 involves modifying at least one cluster centroid position according to gain contributions of audio objects in the corresponding cluster. As noted above, in some implementations a cluster centroid position may simply be the position of an audio object selected as a representative of a cluster. In implementations that include optional block 1015, the representative audio object position may be an initial cluster centroid position. After performing the above-mentioned procedures to determine audio object signal contributions to each cluster, in such implementations at least one modified cluster centroid position may be determined according to the determined gains.

Figure 10C:
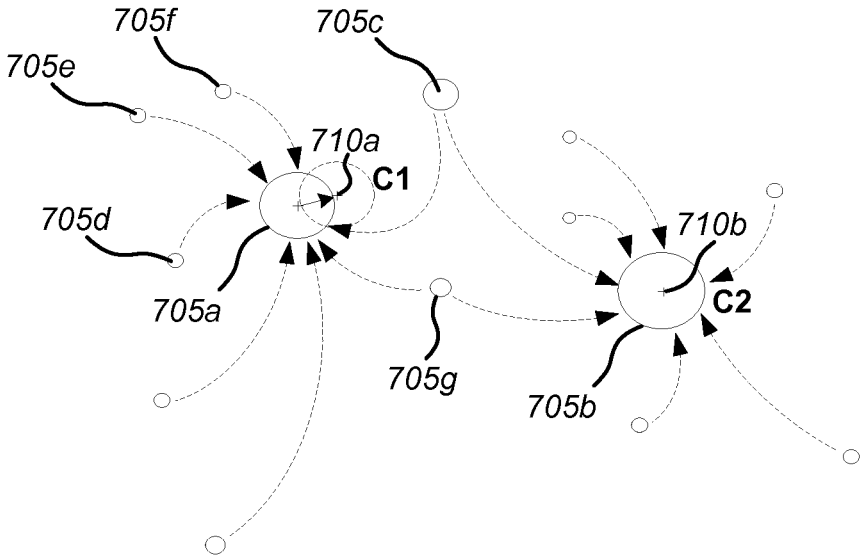
FIGS. 10C and 10D provide examples of modifying a cluster centroid position according to gain contributions of audio objects in the corresponding cluster.
Figure 10D:
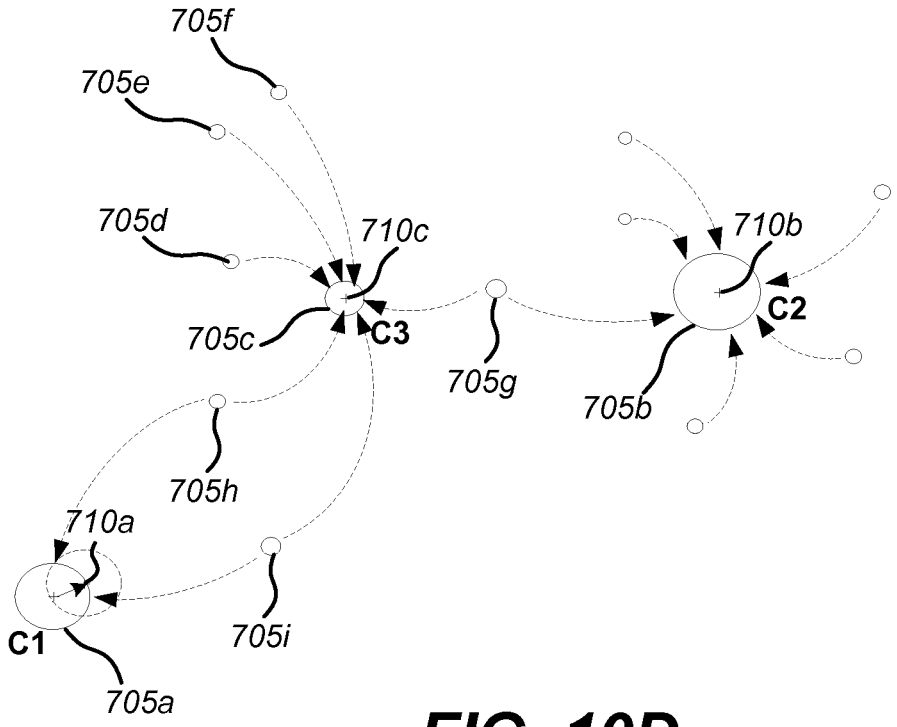

FIGS. 10C and 10D provide examples of modifying a cluster centroid position according to gain contributions of audio objects in the corresponding cluster. FIGS. 10C and 10D are modified versions of FIGS. 7A and 7B. In FIG. 10C, the position of cluster centroid 710*a* has been modified after performing the above-mentioned procedures to determine audio object signal contributions to clusters C1 and C2. In this example, the position of cluster centroid 710*a* has been shifted closer to audio object 705*c*, the second-loudest audio object in cluster C1: the modified position of cluster centroid 710*a* is shown with a dashed outline.

Similarly, In FIG. 10D, the position of cluster centroid 710*a* has been modified after performing the above-mentioned procedures to determine audio object signal contributions to clusters C1, C2 and C3. In this example, the position of cluster centroid 710*a* has been shifted closer to a midpoint of audio objects 705*h* and 705*i*, the only other audio objects in cluster C1 at this time.

Figure 10E:
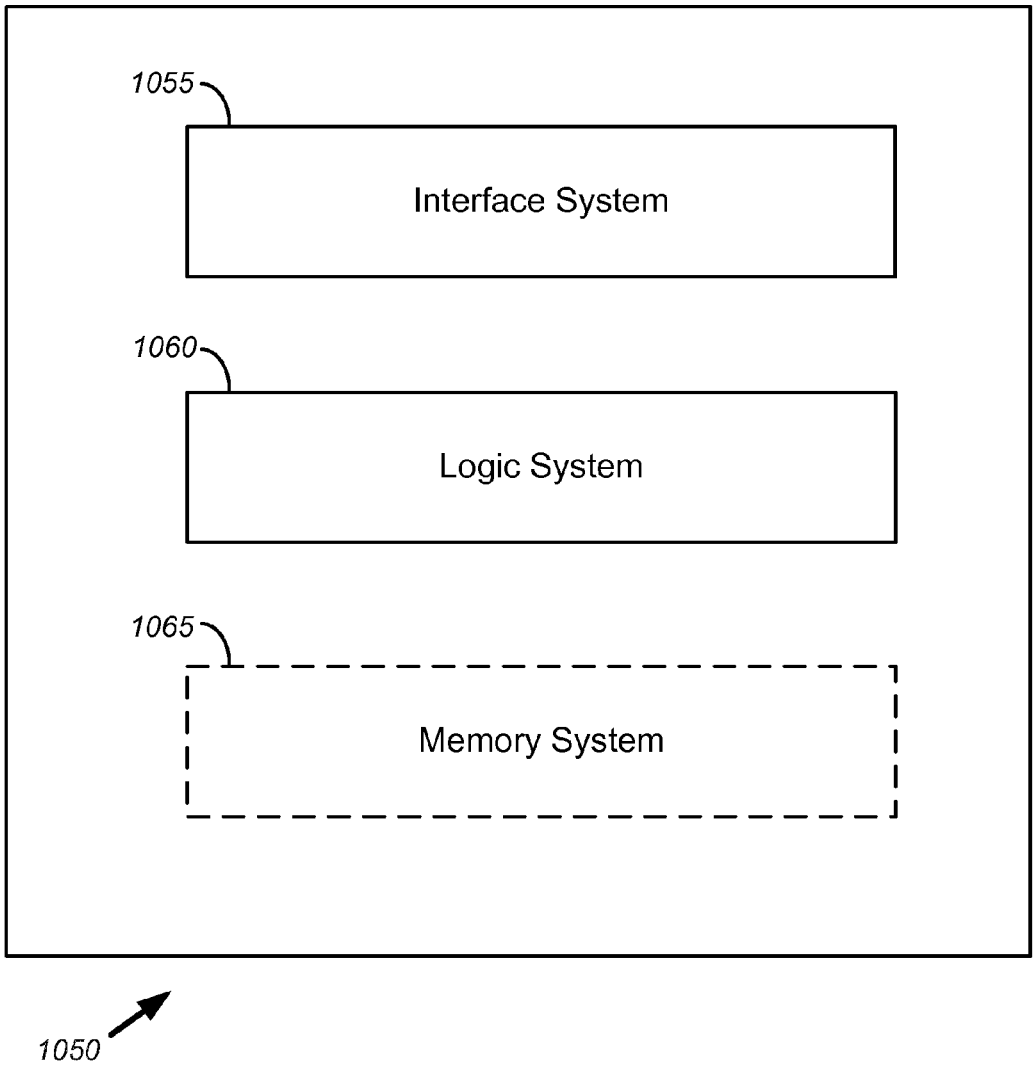
FIG. 10E is a block diagram that provides examples of components of an apparatus capable of implementing various aspects of this disclosure.

FIG. 10E is a block diagram that provides examples of components of an apparatus capable of implementing various aspects of this disclosure. The apparatus 1050 may, for example, be (or may be a portion of) an audio processing system.

In this example, the apparatus 1050 includes an interface system 1055 and a logic system 1060. The logic system 1060 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components.

In this example, the apparatus 1050 includes a memory system 1065. The memory system 1065 may include one or more suitable types of non-transitory storage media, such as flash memory, a hard drive, etc. The interface system 1055 may include a network interface, an interface between the logic system and the memory system and/or an external device interface (such as a universal serial bus (USB) interface).

In this example, the logic system 1060 is capable of performing, at least in part, the methods disclosed herein. For example, the logic system 1060 may be capable of receiving, via the interface system, audio data comprising N audio objects, including audio signals and associated metadata. The metadata may include at least audio object position data.

In some implementations, the logic system 1060 may be capable of determining a gain contribution of the audio object signal for each of the N audio objects to at least one of M speakers. Determining the gain contribution may involve determining a center of loudness position that is a function of speaker positions and gains assigned to each speaker and determining a minimum value of a cost function. A first term of the cost function may represent a difference between the center of loudness position and an audio object position. Determining the center of loudness position may involve combining speaker position via a weighting process in which a weight applied to a speaker position corresponds to a gain assigned to the speaker position.

In some implementations, the logic system 1060 may be capable of performing an audio object clustering process that produces M clusters from the N audio objects, M being a number less than N. The clustering process may involve selecting M representative audio objects and determining a cluster centroid position for each of the M clusters according to audio object position data of each of the M representative audio objects. Each cluster centroid position may, for example, be a single position that is representative of positions of all audio objects associated with a cluster.

The logic system 1060 may be capable of determining a gain contribution of the audio object signal for each of the N audio objects to at least one of the M clusters. Determining the gain contribution may involve determining a center of loudness position that is a function of cluster centroid positions and gains assigned to each cluster and determining a minimum value of a cost function. In some implementations, determining the center of loudness position may involve combining cluster centroid positions via a weighting process in which a weight applied to a cluster centroid position corresponds to a gain assigned to the cluster centroid position. At least one cluster centroid position may be time-varying.

A first term of the cost function may represent a difference between the center of loudness position and an audio object position. A second term of the cost function may represent a distance between the object position and a speaker position or a cluster centroid position. For example, the second term of the cost function may be proportional to a square of the distance between the object position and a speaker position or a cluster centroid position. A third term of the cost function may set a scale for determined gain contributions. The cost function may be a quadratic function of the gains assigned to each speaker or cluster.

In some implementations, the logic system 1060 may be capable of performing, at least in part, the methods disclosed herein according to software stored one or more non-transitory media. The non-transitory media may include memory associated with the logic system 1060, such as random access memory (RAM) and/or read-only memory (ROM). The non-transitory media may include memory of the memory system 1065.

Figure 11:
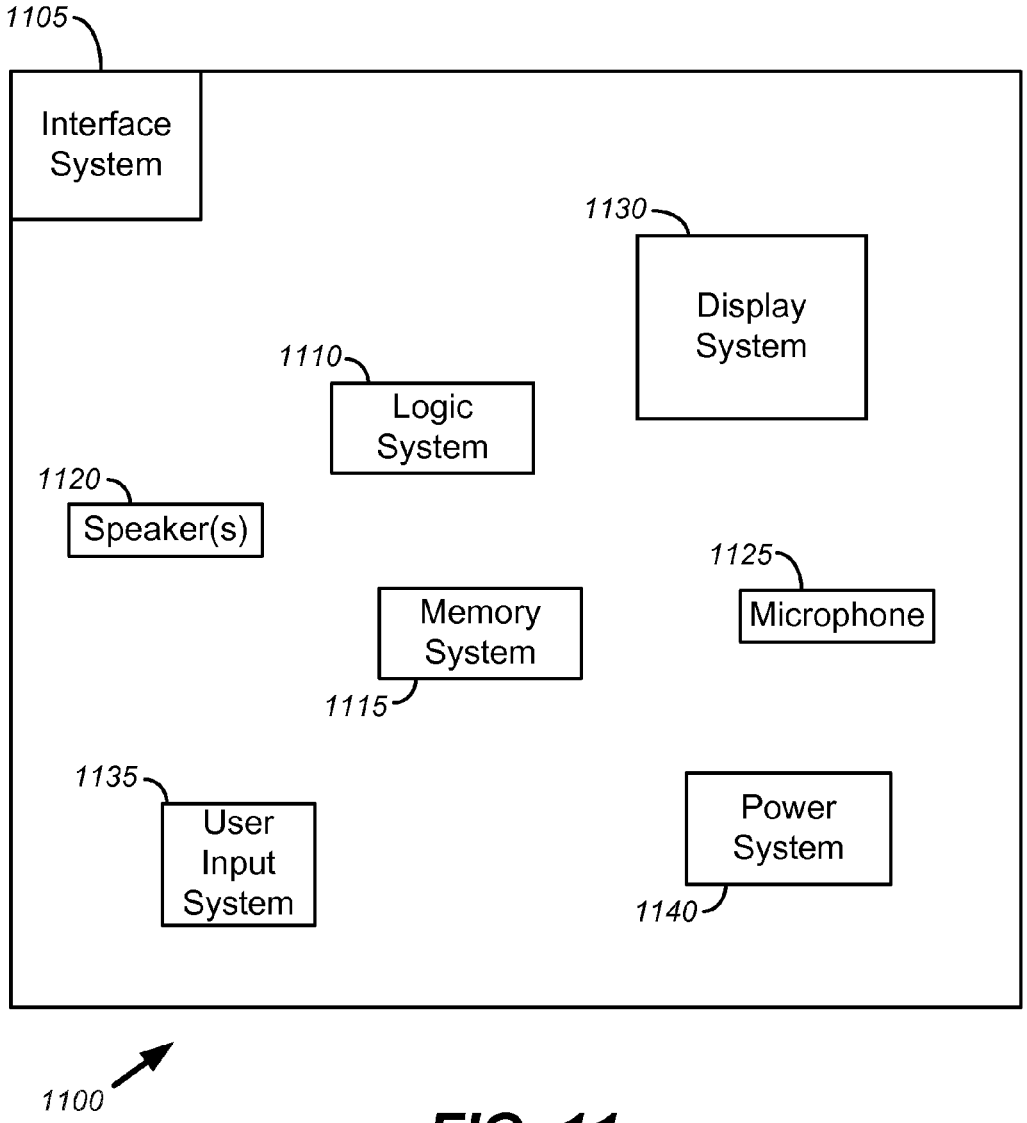
FIG. 11 is a block diagram that provides examples of components of an audio processing apparatus.

FIG. 11 is a block diagram that provides examples of components of an audio processing system. In this example, the audio processing system 1100 includes an interface system 1105. The interface system 1105 may include a network interface, such as a wireless network interface. Alternatively, or additionally, the interface system 1105 may include a universal serial bus (USB) interface or another such interface.

The audio processing system 1100 includes a logic system 1110. The logic system 1110 may include a processor, such as a general purpose single- or multi-chip processor. The logic system 1110 may include a digital signal processor (DSP), an application specific integrated circuit (ASIC), a field programmable gate array (FPGA) or other programmable logic device, discrete gate or transistor logic, or discrete hardware components, or combinations thereof. The logic system 1110 may be configured to control the other components of the audio processing system 1100. Although no interfaces between the components of the audio processing system 1100 are shown in FIG. 11, the logic system 1110 may be configured with interfaces for communication with the other components. The other components may or may not be configured for communication with one another, as appropriate.

The logic system 1110 may be configured to perform audio processing functionality, including but not limited to the types of functionality described herein. In some such implementations, the logic system 1110 may be configured to operate (at least in part) according to software stored one or more non-transitory media. The non-transitory media may include memory associated with the logic system 1110, such as random access memory (RAM) and/or read-only memory (ROM). The non-transitory media may include memory of the memory system 1115. The memory system 1115 may include one or more suitable types of non-transitory storage media, such as flash memory, a hard drive, etc.

The display system 1130 may include one or more suitable types of display, depending on the manifestation of the audio processing system 1100. For example, the display system 1130 may include a liquid crystal display, a plasma display, a bistable display, etc.

The user input system 1135 may include one or more devices configured to accept input from a user. In some implementations, the user input system 1135 may include a touch screen that overlays a display of the display system 1130. The user input system 1135 may include a mouse, a track ball, a gesture detection system, a joystick, one or more GUIs and/or menus presented on the display system 1130, buttons, a keyboard, switches, etc. In some implementations, the user input system 1135 may include the microphone 1125: a user may provide voice commands for the audio processing system 1100 via the microphone 1125. The logic system may be configured for speech recognition and for controlling at least some operations of the audio processing system 1100 according to such voice commands. In some implementations, the user input system 1135 may be considered to be a user interface and therefore as part of the interface system 1105.

The power system 1140 may include one or more suitable energy storage devices, such as a nickel-cadmium battery or a lithium-ion battery. The power system 1140 may be configured to receive power from an electrical outlet.

Various modifications to the implementations described in this disclosure may be readily apparent to those having ordinary skill in the art. The general principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

The invention claimed is:

1. A method, comprising:

receiving audio data comprising N audio objects, the audio objects including audio signals and associated metadata, the metadata including at least audio object position data; and performing an audio object clustering process that produces M clusters from the N audio objects, M being a number less than N, wherein the clustering process comprises:

selecting M representative audio objects;

determining a cluster centroid position for each of the M clusters according to audio object position data of each of the M representative audio objects, each cluster centroid position being a single position that is representative of positions of all audio objects associated with a cluster; and determining a gain contribution of the audio signal for each of the N audio objects to at least one of the M clusters, wherein determining the gain contribution involves:

determining a center of loudness position that is a function of cluster centroid positions and gains assigned to each cluster; and determining a minimum value of a cost function, the cost function including three terms, a first term representing a difference between the center of loudness position and an audio object position, a second term representing a distance between the object position and a cluster centroid position and a third term setting a scale for determined gain contributions allowing the cost function to discriminate between determined gain contributions and select a single set of gain contributions from multiple sets of gain contributions, wherein the number of clusters is minimized for which the single set of gain contributions is selected, wherein determining the center of loudness position involves:

determining products of each cluster centroid position and a gain assigned to each cluster centroid position;

calculating a sum of the products;

determining a sum of the gains for all cluster centroid positions; and dividing the sum of the products by the sum of the gains.

2. The method of claim 1, wherein determining the center of loudness position involves combining cluster centroid positions via a weighting process in which a weight applied to a cluster centroid position corresponds to a gain assigned to the cluster centroid position.

3. The method of claim 1, wherein the second term of the cost function is proportional to a square of the distance between the object position and a cluster centroid position.

4. The method of claim 1, wherein the cost function is a quadratic function of the gains assigned to each cluster.

5. The method of claim 1, further comprising modifying at least one cluster centroid position according to gain contributions of audio objects in the corresponding cluster.

6. The method of claim 1, wherein at least one cluster centroid position is time-varying.

7. A non-transitory medium having software stored thereon, the software including instructions for controlling at least one apparatus to perform the method of claim 1.

8. An apparatus, comprising:

an interface system; and a logic system capable of:

receiving, via the interface system, audio data comprising N audio objects, the audio objects including audio signals and associated metadata, the metadata including at least audio object position data; and performing an audio object clustering process that produces M clusters from the N audio objects, M being a number less than N, wherein the clustering process comprises:

selecting M representative audio objects;

determining a cluster centroid position for each of the M clusters according to audio object position data of each of the M representative audio objects, each cluster centroid position being a single position that is representative of positions of all audio objects associated with a cluster; and determining a gain contribution of the audio object signal for each of the N audio objects to at least one of the M clusters, wherein determining the gain contribution involves:

determining a center of loudness position that is a function of cluster centroid positions and gains assigned to each cluster; and determining a minimum value of a cost function, the cost function including three terms, a first term representing a difference between the center of loudness position and an audio object position, a second term representing a distance between the object position and a cluster centroid position and a third term setting a scale for determined gain contributions allowing the cost function to discriminate between determined gain contributions and select a single set of gain contributions from multiple sets of gain contributions, wherein the number of clusters is minimized for which the single set of gain contributions is selected, wherein determining the center of loudness position involves:

determining products of each cluster centroid position and a gain assigned to each cluster centroid position;

calculating a sum of the products;

determining a sum of the gains for all cluster centroid positions; and dividing the sum of the products by the sum of the gains.

9. The apparatus of claim 8, wherein determining the center of loudness position involves combining cluster centroid positions via a weighting process in which a weight applied to a cluster centroid position corresponds to a gain assigned to the cluster centroid position.

10. The apparatus of claim 8, wherein the second term of the cost function is proportional to a square of the distance between the object position and a speaker position or a cluster centroid position.

11. The apparatus of claim 8, wherein at least one cluster centroid position is time-varying.

12. The apparatus of claim 8, wherein the cost function is a quadratic function of the gains assigned to each speaker or cluster.

13. The apparatus of claim 8, further comprising a memory device, wherein the interface comprises an interface between the logic system and the memory device.

14. The apparatus of claim 8, wherein the interface system comprises a network interface.

15. The apparatus of claim 8, wherein the logic system includes at least one element selected from a group of elements consisting of a general purpose single- or multichip processor, a digital signal processor (DSP), an application specific integrated circuit (ASIC), a field programmable gate array (FPGA) or other programmable logic device, discrete gate or transistor logic and discrete hardware components.

* * * * *